US006820955B1

(12) United States Patent
Usui

(10) Patent No.: US 6,820,955 B1
(45) Date of Patent: Nov. 23, 2004

(54) INK-JET RECORDING APPARATUS, RECORDING METHOD AND RECORDING MEDIUM

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 369 days.

(21) Appl. No.: 09/686,959

(22) Filed: Oct. 12, 2000

(30) Foreign Application Priority Data

Oct. 12, 1999 (JP) ..... 11-290165
Feb. 7, 2000 (JP) ..... 2000-028498
Sep. 6, 2000 (JP) ..... 2000-269995

(51) Int. Cl.[7] ..... B41J 2/195
(52) U.S. Cl. ..... 347/7; 347/14; 347/17
(58) Field of Search ..... 347/7, 14, 17, 347/19, 23, 30; 73/290; 116/227; 137/557, 161, 95; 340/612, 618

(56) References Cited

U.S. PATENT DOCUMENTS 5,136,305 A * 8/1992 Ims ..... 347/7
5,781,204 A 7/1998 Kanematsu et al.
5,900,888 A * 5/1999 Kurosawa ..... 347/7
6,145,949 A * 11/2000 Takahashi ..... 347/14
6,226,025 B1 * 5/2001 Kim ..... 347/228
6,290,321 B1 * 9/2001 Murray et al. ..... 347/19

FOREIGN PATENT DOCUMENTS

EP 0 744 296 A1 11/1996
EP 0 788 882 A2 8/1997
EP 0 956 964 A2 11/1999
JP 4-197759 7/1992
JP 5-050590 * 2/1993
JP 6-278283 10/1994 ..... B41J/2/05
JP 6-344571 12/1994
JP 7-256894 10/1995 ..... B41J/2/175
JP 7-290720 11/1995
JP 7-324989 12/1995
JP 8-127140 5/1996 ..... B41J/2/30
JP 8-197748 * 8/1996
JP 9-136428 5/1997
JP 9-156125 6/1997
JP 10-6526 1/1998
JP 10-315502 12/1998
JP 11-78065 3/1999 ..... B41J/2/18
JP 11-221932 A 8/1999
JP 2001-212988 8/2001

OTHER PUBLICATIONS

English language abstract 06278283A Oct. 4, 1994.
English language abstract 07256894A Oct. 9, 1995.
English language abstract 08127140A May 21, 1996.
English language abstract 11078065A Mar. 23, 1999.

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

Disclosed is an ink-jet recording apparatus, which is for making an ejection amount of ink droplets constant even when a temperature change occurs in a place where ink-jet recording apparatus is used, performing recording with stable image quality, and grasping accurately an ink reservation amount. The temperature change amount of a recording head is obtained based on head temperature information stored in a backup memory (S17), an ink reservation amount in an ink cartridge is obtained (S16), and the ink consumption amount of a head is controlled based on the temperature change amount and the ink reservation amount (S17).

72 Claims, 20 Drawing Sheets

INK-JET RECORDING APPARATUS, RECORDING METHOD AND RECORDING MEDIUM

BACKGROUND OF THE INVENTION

The present invention relates to an ink-jet recording apparatus that ejects ink reserved in an ink reservoir such as an ink cartridge and an ink tank from a recording head, an ink-jet recording method and an ink-jet recording medium.

An ink-jet recording apparatus such as an ink-jet printer and an ink-jet plotter (hereinafter referred to as a recording apparatus) comprises a recording head that is for ejecting ink as ink droplets, which is reserved in an ink reservoir such as an ink cartridge and an ink tank. In the recording apparatus, the recording head is made to move along a main scanning direction, and ink droplets are ejected from the recording head so as to interlock with the movement of the recording head.

Incidentally, if an environmental temperature (for example, a room temperature) at a place where the recording apparatus is used is changed, the ejection amount of ink droplets fluctuates since ink viscosity is changed. For example, when the environmental temperature is higher than a reference temperature on design, the ink viscosity becomes lower than a normal state. Thus, when the ink droplets are ejected in a standard driving pulse, the amount of ejected ink droplets becomes larger than a designed value. Conversely, when the environmental temperature is lower than the reference temperature, the ink viscosity becomes higher than a normal state. Thus, when the ink droplets are ejected in a standard driving pulse, the amount of ejected ink droplets becomes smaller than a designed value. Such fluctuation of the ink amount is a cause of deterioration of image quality.

Accordingly, in order to prevent the ink amount from fluctuating along with the change of environmental temperature, a recording apparatus is provided, in which a temperature sensor such as a thermistor is provided, for example, on a recording head or a carriage, and the driving signal that drives the piezoelectric element based on head temperature information detected by the temperature sensor is adjusted.

In the recording apparatus, for example, when the head temperature information value is lower than the reference temperature, the driving voltage for a driving pulse included in the driving signal is set higher than the standard value. On the contrary, when the head temperature information value is higher than the reference temperature, the driving voltage for the driving pulse included in the driving signal is set lower than the standard value.

However, since the head temperature information used for driving signal adjustment is an environmental temperature, such as a room temperature, a difference thereof of the temperature of ink reserved in an ink reservoir may occur in some cases. This is because the heat capacity of ink is larger than the heat capacity of air, and because ink has a property that it is harder to heat and harder to cool down. And, when a difference exists between the head temperature information value and the ink temperature; it is difficult to unify ink droplets in a desired amount even if the driving signal is adjusted based on the head temperature information.

Such a phenomenon is prominent when a rapid temperature change occurs in a place where the printing apparatus is used, such as on an occasion that air conditioning is turned on in summer or heating is turned on in winter.

SUMMARY OF INVENTION

The present invention was invented in consideration of the foregoing problems, and the object of the present invention is to provide an ink-jet recording apparatus, an ink-jet recording method, and an ink-jet recording medium, which can accurately grasp the ink reservation amount in the ink reservoir by unifying the ejection amount of ink droplets even if a temperature change occurs in a place where the recording apparatus is used, and can obtain a recorded image of stable quality.

A first aspect of the present invention for solving the foregoing problems is an ink-jet recording apparatus, which has a recording head for ejecting ink from an ink reservoir and driving signal generating means for generating a driving signal for ejecting ink droplets, characterized in that it comprises: ink reservation amount obtaining means for obtaining the ink reservation amount in the ink reservoir; temperature change amount obtaining means for obtaining the temperature change amount of the recording head; and ink consumption amount controlling means for controlling the ink consumption amount of the recording head based on the temperature change amount of the recording head obtained by the temperature change amount obtaining means and the ink reservation amount obtained by the ink reservation amount obtaining means.

In the first aspect, since the ink consumption amount controlling means can control the ink consumption amount suitable to the actual ink temperature in accordance with the temperature change amount and the ink reservation amount of the recording head, the ink consumption amount of the recording head can be stable regardless of the change of environmental temperature. Moreover, the ink reservation amount in the ink reservoir can be accurately grasped by controlling the ink consumption amount.

A second aspect of the present invention is the ink-jet recording apparatus in the first aspect, characterized in that the ink consumption amount controlled by the ink consumption amount controlling means is the a ink consumption amount by ink ejection and preparatory ejection.

In the second aspect, by controlling the ink consumption amount of the ink ejection and the preparatory ejection by the ink consumption amount controlling means, stable ink ejection can be performed regardless of the environmental temperature.

A third aspect of the present invention is the ink-jet recording apparatus in the second aspect, characterized in that the ink consumption amount controlled by the ink consumption amount controlling means further includes the ink consumption amount by a sucking operation.

In the third aspect, by controlling the ink consumption amount by the sucking operation of the ink consumption amount controlling means, the sucked amount can be maintained in a specified amount regardless of the environmental temperature.

A fourth aspect of the present invention is the ink-jet recording apparatus in any one of the first to third aspects, characterized in that the ink reservation amount obtaining means detects the ink consumption amount and obtains the ink reservation amount in the ink reservoir.

In the fourth aspect, by detecting the ink consumption amount through totalizing the controlled ink consumption amount, the ink reservation amount in the ink reservoir can be accurately grasped.

A fifth aspect of the present invention is the ink-jet recording apparatus in the fourth aspect, characterized in that the ink consumption amount detected by the ink reservation amount obtaining means is the ejected amount of ink in a recording operation, the ejected amount of ink in a preparatory ejection operation and the sucked amount of ink in a sucking operation.

In the fifth aspect, the ink reservation amount in the ink reservoir can be accurately grasped from the ink ejection amount in the recording operation, the ink ejection amount in the preparatory ejection operation and the ink sucking amount in the sucking operation.

A sixth aspect of the present invention is the ink-jet recording apparatus in any one of the first to fifth aspects, characterized in that the temperature change amount obtaining means comprises temperature detecting means for detecting the temperature of the recording head and temperature information storing means for storing the head temperature information from the temperature detecting means.

In the sixth aspect, the change of amount of the recording head temperature can be obtained relatively easily by the temperature detecting means and the temperature information storing means.

A seventh aspect of the present invention is the ink-jet recording apparatus in the sixth aspect, characterized in that the temperature information storing means stores the recording head temperature information from the time when a power source is turned on.

In the seventh aspect, since the recording head temperature information is stored from the time when the power source is turned on can be obtained, the change of amount of the recording head temperature from the time when the power source is tuned on and the ink consumption amount controlling means can control the ink consumption amount suitable to the ink temperature based on more information.

An eighth aspect of the present invention is the ink-jet recording apparatus in any one of the sixth and seventh aspects, characterized in that the temperature information storing means stores the head temperature information in a waiting state of the recording operation.

In the eighth aspect, since the head temperature information is stored even in the waiting state, the ink consumption amount controlling means can control the ink consumption amount suitable to the ink temperature based on more information.

A ninth aspect of the present invention is the ink-jet recording apparatus in any one of the sixth to eighth aspects, characterized in that the temperature information storing means holds the stored head temperature information even after the power source is turned off.

In the ninth aspect, since the head temperature information is stored even after the power source is turned off, the ink consumption amount controlling means can control the ink consumption amount suitable to the ink temperature based on more information when the power source is turned on again.

A tenth aspect of the present invention is the ink-jet recording apparatus in the ninth aspect, characterized in that the temperature change amount obtaining means obtains a temperature change amount by using the head temperature information held in the temperature information storing means when the power source is turned on again within a specified time after the power source is turned off.

In the tenth aspect, when the power source is turned on within a specified time, the ink consumption amount controlling means can control the ink consumption amount suitable to the ink temperature by using the head temperature information value before the power source was turned off.

An eleventh aspect of the present invention is the ink-jet recording apparatus in any one of the first to tenth aspects, characterized in that the driving signal generating means generates a driving signal that makes the recording head perform a recording operation, and the ink consumption amount controlling means adjusts the driving signal for the recording operation.

In the eleventh aspect, the ink consumption amount controlling means can control the ink consumption amount in the recording operation with the driving signal suitable for the ink temperature by adjusting the driving signal for the recording operation.

A twelfth aspect of the present invention is the ink-jet recording apparatus in the eleventh aspect, characterized in that the driving signal generating means generates the driving signal including the driving pulse for ejecting ink droplets, and the ink consumption amount controlling means adjusts the driving voltage of the driving pulse based on the temperature change amount and the ink reservation amount.

In the twelfth aspect, the ink consumption amount controlling means can control the ink consumption amount with the driving voltage suitable to the ink temperature by adjusting the driving voltage.

A thirteenth aspect of the present invention is the ink-jet recording apparatus in any one of the eleventh and twelfth aspects characterized in that the driving signal generating means generates the driving signal including the driving pulse for ejecting ink droplets, and the ink consumption amount controlling means adjusts the pulse form of the driving pulse based on the temperature change amount and the ink reservation amount.

In the thirteenth aspect, the ink consumption amount controlling leans can control the ink consumption amount with the pulse form of the driving signal suitable to the ink temperature by changing the pulse form of the driving pulse.

A fourteenth aspect of the present invention is the ink-jet recording apparatus in any one of the eleventh to thirteenth aspects, characterized in that the recording head performs a preparatory ejection operation by using the driving signal of the recording operation.

In the fourteenth aspect, the preparatory ejection operation is performed by using the driving signal of the recording operation, which is adjusted by the ink consumption amount controlling means, thus plugging of a nozzle orifice can be surely prevented and wasted ejection due to the preparatory ejection can be also controlled A fifteenth aspect of the present invention is the ink-jet recording apparatus in any one of the first to thirteenth aspects, characterized in that the ink consumption amount controlling means adjusts control of the preparatory ejection operation.

In the fifteenth aspect, the ink consumption amount controlling means, controls the ink consumption amount at the preparatory ejection by adjusting the control of the preparatory ejection, thus plugging of the nozzle orifice can be surely prevented and the wasted ejection of ink due to the preparatory ejection can be also controlled A sixteenth aspect of the present invention is the ink-jet recording apparatus in the fifteenth aspect, characterized in that the ink consumption amount controlling means adjusts the pulse form for the ejection in the preparatory ejection operation.

In the sixteenth aspect, since the preparatory ejection pulse form by the preparatory ejection operation suitable to the actual ink temperature is adjusted, ink is surely ejected and consumption of wasted ink is controlled.

A seventeenth aspect of the present invention is the ink-jet recording apparatus in any one of the fifteenth and sixteenth aspects, characterized in that the ink consumption amount controlling means adjusts the number of ejections in one preparatory ejection operation.

In the seventeenth aspect, the ink consumption amount in one preparatory ejection operation is adjusted, ink of increased viscosity is surely ejected and consumption of wasted ink is controlled.

An eighteenth aspect of the present invention is the ink-jet recording apparatus in any one of the fifteenth to seventeenth aspects, characterized in that the ink consumption amount controlling means adjusts the interval of the preparatory ejection operation.

In the eighteenth aspect, since the frequency of the preparatory ejection operation is adjusted, ink of increased viscosity is surely ejected and consumption of wasted ink is controlled.

A nineteenth aspect of the present invention is the ink-jet recording apparatus in any one of the fifteenth to eighteenth aspects, characterized in that the ink consumption amount controlling means adjusts the ejection cycle in the preparatory ejection operation.

In the nineteenth aspect, the ink consumption amount by the preparatory ejection operation is adjusted and stability of ink ejection is improved, thus ink of increased viscosity is surely ejected and consumption of wasted ink is controlled.

A twentieth aspect of the present invention is the ink-jet recording apparatus in any one of the first to nineteenth aspects, characterized in that it further comprises: micro-vibration drive controlling means for making ink in the recording head perform micro-vibration; and changing means for adjusting control of the micro-vibration drive controlling means based on the temperature change amount of the recording head obtained by the temperature change amount obtaining means and the ink reservation amount obtained by the ink reservation amount obtaining means.

In the twentieth aspect, since the control of the micro-vibration drive is adjusted according to the actual ink temperature, ink leakage from the nozzle orifice is prevented and ink agitation is surely performed.

A twenty-first aspect of the present invention is the ink-jet recording apparatus in the twentieth aspect, characterized in that the changing means adjusts the pulse form for the micro-vibration in the micro-vibration drive.

In the twenty-first aspect, since the pulse form for the micro-vibration drive suitable to the actual ink temperature is adjusted, ink leakage from the nozzle orifice is prevented and ink agitation is surely performed.

A twenty-second aspect of the present invention is the ink-jet recording apparatus in any one of the twentieth and twenty-first aspects, characterized in that the changing means adjusts the pulse number of the micro-vibration drive.

In the twenty-second aspect, since the pulse number of the micro-vibration drive suitable to the actual ink temperature is adjusted, ink leakage from the nozzle orifice is prevented and ink agitation is surely preformed.

A twenty-third aspect of the present invention is the ink-jet recording apparatus in any one of the twentieth to twenty-second aspects, characterized in that the changing means adjusts the drive interval of the micro-vibration drive.

In the twenty-third aspect, since the frequency of the micro-vibration drive is adjusted, ink of increased viscosity is surely agitated and ink leakage from the nozzle orifice due to agitation is prevented.

A twenty-fourth aspect of the present invention is the ink-jet recording apparatus in any one of the twentieth to twenty-third aspects, characterized in that the changing means adjusts the drive cycle of the micro-vibration drive.

In the twenty-fourth aspect, the agitated amount of ink due to the micro-vibration drive is adjusted and the stability of ink agitation is improved, thus the ink of increased viscosity is surely agitated and ink leakage from the nozzle orifice due to agitation is prevented.

A twenty-fifth aspect of the present invention is an ink-jet recording method, in which the ink-jet recording apparatus has a recording head for ejecting ink from an ink reservoir and driving signal generating means for generating a driving signal to eject ink droplets, which comprises the steps of: obtaining the ink reservation amount in the ink reservoir and obtaining the temperature change amount of the recording head; and controlling the ink consumption amount of the recording head based on the temperature change amount of the recording head and the ink reservation amount.

In the twenty-fifth aspect, since the ink consumption amount suitable to the actual ink temperature can be controlled according to the temperature change amount of the recording head and the ink reservation amount, the recording head can perform stable ejection regardless of an environmental temperature change. Moreover, the ink reservation amount in the ink reservoir can be accurately grasped by controlling the ink consumption amount.

A twenty-sixth aspect of the present invention is the ink-jet recording method in the twenty-fifth aspect, characterized in that in the step of controlling of the ink consumption amount, the ink consumption amount due to ink ejection and preparatory ejection is controlled.

In the twenty-sixth aspect, stable ink ejection can be performed regardless of environmental temperature by controlling the ink consumption amount due to ink ejection and preparatory ejection.

A twenty-seventh aspect of the present invention is the ink-jet recording method in the twenty-sixth aspect, characterized in that in the step of controlling the ink consumption amount, the ink consumption amount due to the sucking operation is further controlled.

In the twenty-seventh aspect, the sucked amount always can be held at a specified amount regardless of environmental temperature by controlling the ink consumption amount due to the sucking operation.

A twenty-eighth aspect of the present invention is the ink-jet recording method in any one of the twenty-fifth to twenty-seventh aspects, characterized in that the ink reservation amount is obtained by calculation based on totalization of the ink consumption amount.

In the twenty-eighth aspect, the ink reservation amount in the ink reservoir can be accurately grasped by totalizing the controlled ink consumption amount.

A twenty-ninth aspect of the present invention is the ink-jet recording method in the twenty-eighth aspect, characterized in that the ink consumption amount is the ink ejection amount in the recording operation, the ink ejection amount in the preparatory ejection operation, and the ink sucking amount in the sucking operation.

In the twenty-ninth aspect, the ink reservation amount in the ink reservoir can be accurately grasped from the ink ejection amount of the recording operation, the ink ejection amount of the preparatory ejection operation, and the ink sucking amount of the sucking operation.

A thirtieth aspect of the present invention is the ink-jet recording method in any one of the twenty-fifth to twenty-ninth aspects, characterized in that the step of obtaining a temperature change amount of a recording head comprises the steps of: detecting the temperature of the recording head, and storing the detected head temperature information.

In the thirtieth aspect, since the recording head temperature is detected to store the head temperature information, the temperature change amount of the recording head can be obtained relatively easily.

A thirty-first aspect of the present invention is the ink-jet recording method in the thirtieth aspect, characterized in that in the step of storing head temperature information, the head temperature information from the time when the power source is turned on is stored.

In the thirty-first aspect, since the head temperature information is stored from the time when the power source is turned on, the temperature change amount of the recording head from the time when the power source is turned on can be obtained and the ink consumption amount suitable to the ink temperature can be controlled from more head temperature information.

A thirty-second aspect of the present invention is the ink-jet recording method in any one of the thirtieth and thirty-first aspects, characterized in that in the step of storing the head temperature information, the head temperature information in the waiting state of the recording operation is stored.

In the thirty-second aspect, since the head temperature information is stored even in the waiting state, the ink consumption amount suitable to the ink temperature can be controlled from more head temperature information.

A thirty-third aspect of the present invention is the ink-jet recording method in any one of the thirtieth to thirty-second aspects, characterized in that in the step of storing head temperature information, the stored head temperature information is held even after the power source is turned off.

In the thirty-third aspect, since the head temperature information is held after the power source is turned off, the ink consumption amount suitable to the ink temperature can be controlled from more head temperature information when the power source is turned on again.

A thirty-fourth aspect of the present invention is the ink-jet recording method in the thirty-third aspect, characterized in that in the step of obtaining the temperature change amount of the recording head, when the power source is turned on again within a specified time after the power source is turned off, the temperature change amount is obtained by using the head temperature information held in the temperature information storing means.

In the thirty-fourth aspect, when the power source is turned on within a specified time, the ink consumption amount suitable to the ink temperature can be controlled by using the head temperature information before the power source was turned off.

A thirty-fifth aspect of the present invention is the ink-jet recording method in any one of the twenty-fifth to thirty-fourth aspects, characterized in that in the step of controlling the ink consumption amount, the driving signal that makes the recording head perform the recording operation is adjusted.

In the thirty-fifth aspect, the ink consumption amount in the recording operation can be controlled with the driving signal suitable to the ink temperature by adjusting the driving signal of the recording operation.

A thirty-sixth aspect of the present invention is the ink-jet recording method in the thirty-fifth aspect, characterized in that the adjustment of the driving signal of the recording operation is adjustment of the driving voltage for a pulse form which is included in the driving signal for ejecting ink droplets.

In the thirty-sixth aspect, the ink consumption amount can be controlled with the driving signal suitable to the ink temperature by adjusting the driving voltage of the driving signal of the recording operation.

A thirty-seventh aspect of the present invention is the ink-jet recording method in any one of the thirty-fifth and thirty-sixth aspects, characterized in that the adjustment of the driving signal of the recording operation is adjustment of the pulse form of the driving pulse, which is included in the driving signal for ejecting ink droplets.

In the thirty-seventh aspect, the ink consumption amount can be controlled with the pulse form of a driving pulse suitable to the ink temperature by adjusting the pulse form of a driving pulse in the recording operation.

A thirty-eighth aspect of the present invention is the ink-jet recording method in any one of the thirty-fifth to thirty-seventh aspects, characterized in that the recording head is made to perform the preparatory ejection operation by using the driving signal of the adjusted recording operation.

In the thirty-eighth aspect, plugging of the nozzle orifice is surely prevented and wasted ejection due to the preparatory ejection can be controlled by performing the preparatory ejection operation by using the driving signal of the recording operation, which is adjusted by the ink consumption amount controlling means.

A thirty-ninth aspect of the present invention is the ink-jet recording method in any one of the twenty-fifth to thirty-seventh aspects, characterized in that in the step of controlling the ink consumption amount, the driving signal for performing the preparatory ejection operation is adjusted.

In the thirty-ninth aspect, plugging of the nozzle orifice is surely prevented and wasted ejection due to the preparatory ejection can be controlled by adjusting the driving signal of the preparatory ejection operation to control the ink consumption amount in the preparatory ejection operation.

A fortieth aspect of the present invention is the ink-jet recording method in the thirty-ninth aspect, characterized in that the adjustment of the driving signal for the preparatory ejection operation is adjustment of the pulse form for the ejection in the preparatory ejection operation.

In the fortieth aspect, since the preparatory ejection pulse form by the preparatory ejection operation is suitable to the actual ink temperature, ink is surely ejected and wasted ink consumption is controlled.

A forty-first aspect of the present invention is the ink-jet recording method in any one of the thirty-ninth and fortieth aspects, characterized in that the adjustment of the driving signal for the preparatory ejection operation is adjustment of the number of ejections in the preparatory ejection operation.

In the forty-first aspect, the ink consumption amount in one preparatory ejection operation is adjusted, ink of increased viscosity is surely ejected, and wasted ink consumption is controlled A forty-second aspect of the present invention is the ink-jet recording method in any one of the thirty-ninth to forty-first aspects, characterized in that the adjustment of the driving signal for the preparatory ejection operation is adjustment of the interval for the preparatory ejection operation.

In the forty-second aspect, since the frequency of the preparatory ejection operation is adjusted, ink of increased viscosity is surely ejected and wasted ink consumption is controlled.

A forty-third aspect of the present invention is the ink-jet recording method in any one of the thirty-ninth to forty-second aspects, characterized in that the adjustment of the driving signal for the preparatory ejection operation is change of the ejection cycle in the preparatory ejection operation.

In the forty-third aspect, the ink consumption amount by the preparatory ejection operation is adjusted, stability of ink ejection is improved, ink of increased viscosity is surely ejected, and wasted ink consumption is controlled.

A forty-fourth aspect of the present invention is the ink-jet recording method in any one of the twenty-fifth to forty-third aspects, characterized in that it further comprises a step of adjusting the driving signal that makes the recording head perform micro-vibration.

In the forty-fourth aspect, since control of the micro-vibration is adjusted in accordance with the actual ink temperature, ink leakage from the nozzle orifice is prevented and ink agitation is surely performed.

A forty-fifth aspect of the present invention is the ink-jet recording method in the forty-fourth aspect, characterized in that the adjustment of the driving signal for performing the micro-vibration drive is adjustment of the pulse form for the micro-vibration in the micro-vibration drive.

In the forty-fifth aspect, since the driving pulse form in the micro-vibration drive suitable to the actual ink temperature is adjusted, ink leakage from the nozzle orifice is prevented and ink agitation is surely performed.

A forty-sixth aspect of the present invention is the ink-jet recording method in any one of the forty-fourth and the forty-fifth aspects, characterized in that the adjustment of the driving signal for performing the micro-vibration drive is adjustment of the pulse number of the micro-vibration drive.

In the forty-sixth aspect, since the pulse number in the micro-vibration drive suitable to the actual ink temperature is adjusted, ink leakage from the nozzle orifice is prevented and ink agitation is surely performed.

A forty-seventh aspect of the present invention is the ink-jet recording method in any one of the forty-fourth to forty-sixth aspects, characterized in that the adjustment of the driving signal for performing the micro-vibration drive is adjustment of the driving interval of the driving signal.

In the forty-seventh aspect, since the frequency of the micro-vibration drive is adjusted, ink of increased viscosity is surely agitated and ink leakage from the nozzle orifice due to agitation is prevented.

A forty-eighth aspect of the present invention is the ink-jet recording method in any one of the forty-fourth to forty-seventh aspects, characterized in that the adjustment of the driving signal for performing the micro-vibration drive is adjustment of the driving cycle of the micro-vibration drive.

In the forty-eighth aspect, the amount of ink agitation by the micro-vibration drive is adjusted and stability of ink agitation is improved, thus ink of increased viscosity is surely agitated and ink leakage from the nozzle orifice due to agitation is prevented.

A forty-ninth aspect of the present invention is a recording medium capable of being read by a computer, which stores a program for controlling the ink consumption amount of the ink-jet recording apparatus executing printing by using a recording head ejecting ink from an ink reservoir. The recording medium is characterized in that the program makes the ink-jet recording method obtain the ink reservation amount in the ink reservoir and the temperature change amount of the recording head, and controls the ink consumption amount of the recording head based on the temperature change amount of the recording head and the ink reservation amount.

In the forty-ninth aspect, the ink consumption amount suitable to the actual ink temperature can be controlled according to the temperature change amount and the ink reservation amount of the recording head, and the recording head can record an image of stable quality regardless of change in the environmental temperature.

BRIEF DESCRIPTION OF THE DRAWINGS

For a more complete understanding of the present invention and the advantages thereof, reference is now made to the following descriptions in conjunction with the accompanying drawings.

FIG. 7 (*a*) shows a reference pulse form; FIG. 7(*b*) a pulse form having a driving voltage set high; and FIG. 7(*c*) a pulse form having a driving voltage set low.

FIG. 8(*a*) shows a pulse form having an intermediate voltage set low; FIG. 8(*b*) a pulse form having a voltage slope of the expansion element set gentle; and FIG. 8 (*c*) a pulse form having the first holding element set long.

FIG. 9(*a*) shows a pulse form having an intermediate voltage set high; FIG. 9(*b*) a pulse form having a voltage slope of the expansion element set large; and FIG. 9(*c*) a pulse form having the first holding element set short.

DESCRIPTION OF THE PREFERRED EMBODIMENTS

Embodiments of the present invention will be described in detail with reference to the drawings as follows.

Embodiment 1

Figure 1:
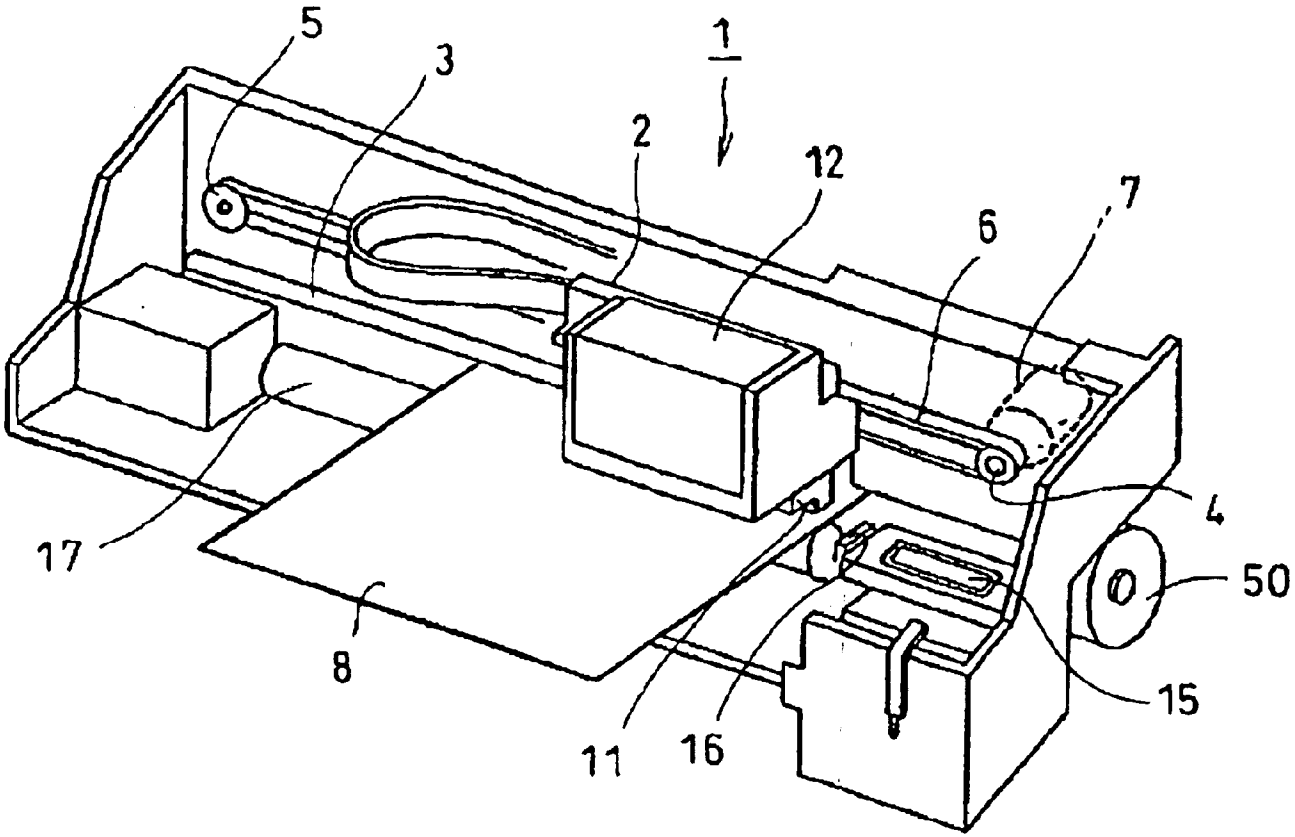
FIG. 1 is a perspective view explaining the printing mechanism of an ink-jet printer according to the embodiment 1 of the present invention.

FIG. 1 is a perspective view of an ink-jet printer 1 that is a representative ink-jet recording apparatus.

In the ink-jet printer 1, a carriage 2 is movably installed on a guide member 3, and the carriage 2 is connected to a timing belt 6 that is hooked on a driving pulley 4 and a free rotating pulley 5. The driving pulley 4 is joined to the rotation axis of a pulse motor 7, and the carriage 2 is made to move (main scanning) in the width direction of a recording paper 8 by drive of the pulse motor 7.

At the opposing surface (the bottom surface) to the recording paper 8 of the carriage 2, a recording head 11 is installed. The recording head 11 ejects ink supplied from an ink cartridge 12 (a kind of ink reservoir of the present invention) mounted on the carriage 2 or ink supplied from an ink tank (a kind of ink reservoir of the present invention, not shown) connected via an ink supplying tube from a nozzle orifice 13 (see FIG. 2) as ink droplets.

In addition, the carriage 2 is attached with a head substrate (not shown), on which various devices for driving the recording head 11 and a temperature sensor 14 (see FIG. 3) or the like are mounted. The above-described temperature sensor 14 functions as the temperature detecting means of the present invention, and it is constituted of, for example, a temperature sensitive device for detecting temperature such as a thermistor. The temperature sensor 14 detects environmental temperature in the vicinity of the recording head 11, and outputs it as head temperature information.

In the edge portion area outside the recording area that is within the moving range of the carriage 2, the home position and the waiting position of the carriage 2 are set.

The home position is a place where the recording head 11 moves to when the power source is turned off or recording is not performed for a long period of time. When the recording head 11 is positioned in the home position, a cap member 15 of a capping mechanism closes the nozzle orifice 13 to prevent ink in close proximity of the nozzle orifice 13 from drying. Moreover, the cap member 15 is connected to the sucking means such as a sucking pump (not shown). The sucking means, by performing a sucking operation to suck ink in close proximity of the nozzle orifice 13 of the recording head 11 , removes residual bubbles or ink of increased viscosity in the ink flow path to prevent printing failure, such as a missing dot. The sucking operation is suitably performed before start of printing or in a printing interval in such a case where the recording head 11 is left in a state of no recording operation for a long time.

Alternatively, regarding the recording head 11 , ink viscosity increases due to temperature change of ink in accordance with a change of surrounding environmental temperature, and plugging occurs in the nozzle orifice 13. For this reason, flushing is performed in a specified period, for example before start of printing or in a printing interval, such that the recording head 11 is made to eject ink droplets to an area other than the area where the recording head 11 opposes to the recording paper 8, for example the cap member 15, in order to discharge ink in close proximity of the nozzle orifice 13.

Moreover, the waiting position is the starting position of the recording head 11 when scanning is performed. In other words, the recording head 11 normally waits at the waiting position, and, at the time of recording operation, the recording head 11 scans from the waiting position to the recording area, and then it returns to the waiting position when the recording operation ends. Additionally, the wiper member 16 of the cleaning mechanism is disposed under the waiting position.

The ink-jet printer 1 constructed as described above, at the time of recording operation, ejects ink droplets from the recording head 11 while synchronizing with the main scanning of the carriage 2, rotates a platen 17 linking with reciprocative movement of the carriage 2, and moves the recording paper 8 in the paper feeding direction (that is, sub-scanning). As a result, images and characters based on printing data are recorded on the printing paper 8.

Description will now be made for the recording head 11.

Figure 2:
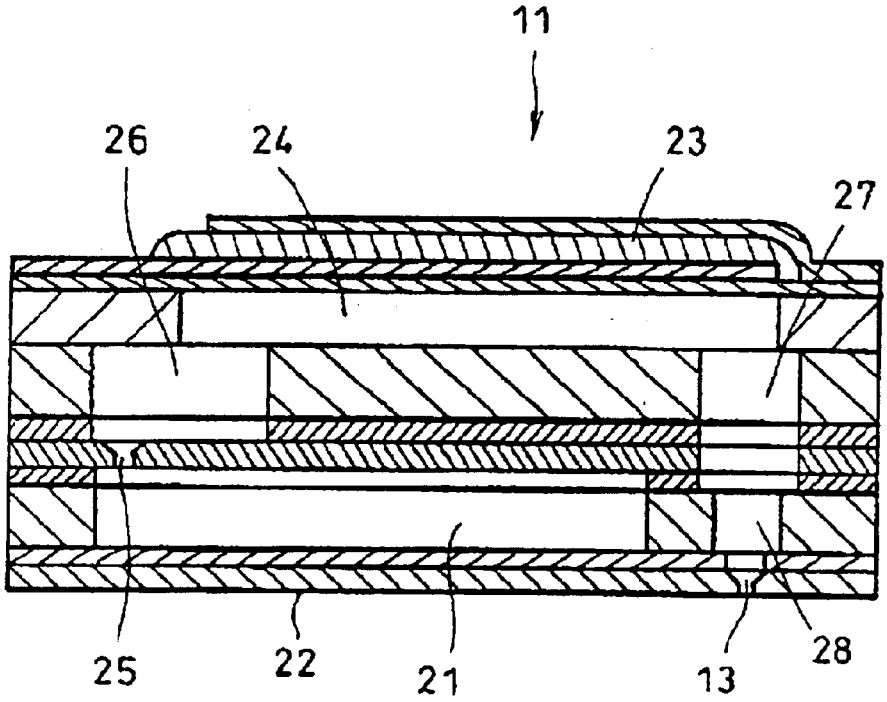
FIG. 2 is a view showing the mechanical structure of a recording head according to the embodiment 1 of the present invention.

The recording head 11 as shown in FIG. 2 comprises an ink chamber 21, where ink from the ink cartridge 12 is supplied, a nozzle plate 22 where a plurality (for example, 64) of nozzle orifices 13 are arranged in the sub-scanning direction, and a pressure chamber 24, which is provided in plural numbers corresponding to respective nozzle orifices 13, that expands/contracts due to deformation of a piezoelectric element 23. Then, the ink chamber 21 and the pressure chamber 24 are communicatively connected with an ink supply orifice 25 and a supplying side communicating bore 26, and the pressure chamber 24 and the nozzle orifice 13 are communicatively connected with the first nozzle communicating bore 27 and the second nozzle communicating bore 28. In other words, a series of ink flow paths from the ink chamber 21 to the nozzle orifice 13 through the pressure chamber 24 is formed for each nozzle orifice 13.

The piezoelectric element 23 is so-called a piezoelectric element 23 of warp vibration mode. When the piezoelectric element 23 of warp vibration mode is used, charging the piezoelectric element 23 leads to contracting of the element in the orthogonal direction of the electric field to allow the pressure chamber 24 contract. When the charged piezoelectric element 23 is discharged, the piezoelectric element 23 expands in the orthogonal direction of the electric field to allow the pressure chamber 24 to expand.

In the recording head 11, since the capacity of the corresponding pressure chamber 24 changes accompanied with charge/discharge to the piezoelectric element 23, ink droplets can be ejected from the nozzle orifice 13 by utilizing pressure fluctuation of the pressure chamber 24.

Note that, alternative to the above-described piezoelectric element 23 of warp vibration mode, a piezoelectric element of so-called vertical vibration mode may be used. The piezoelectric element of vertical vibration mode is a piezoelectric element that expands the pressure chamber 24 by deformation due to charge and contracts the pressure chamber 24 by deformation due to discharge.

Figure 3:
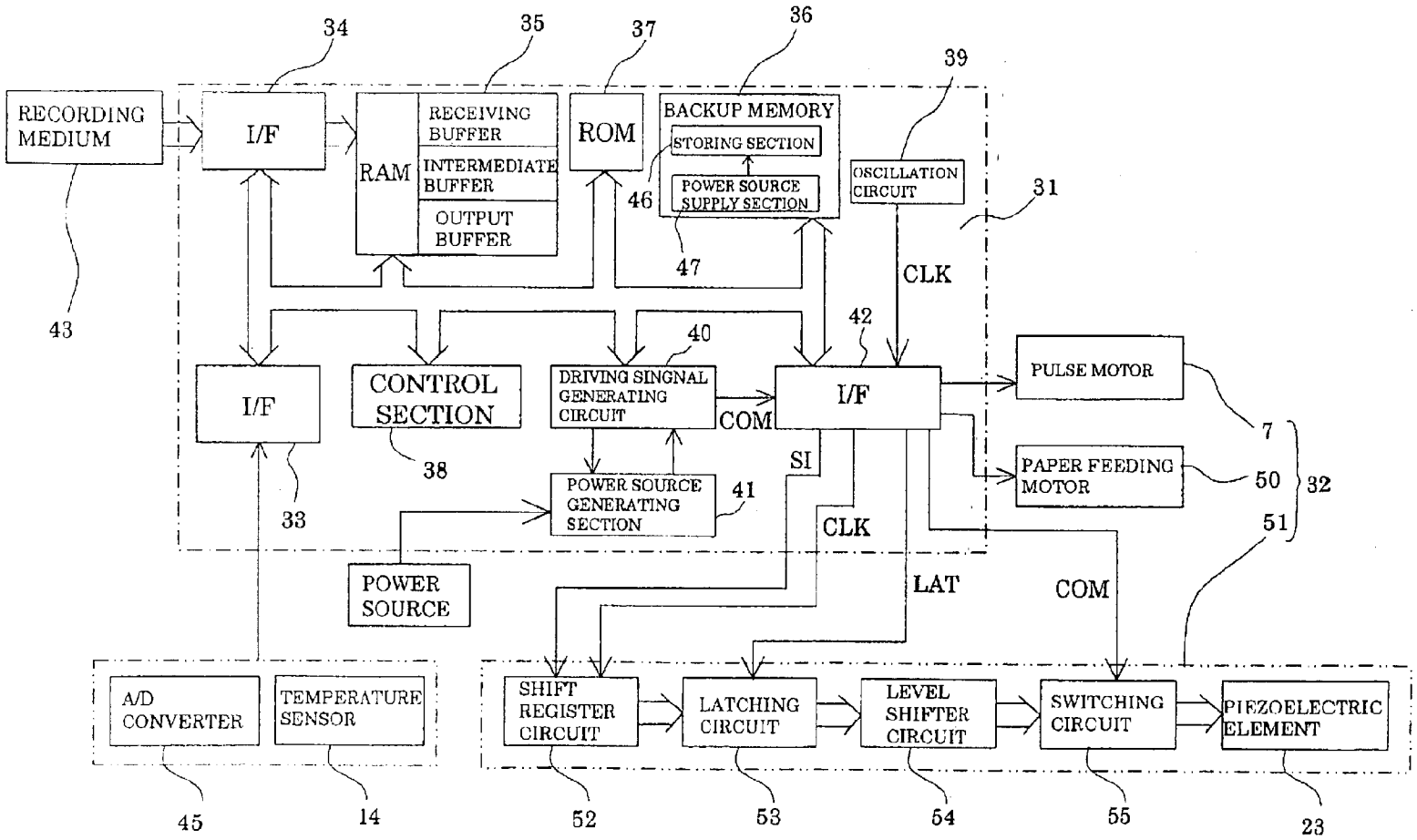
FIG. 3 is a block diagram explaining the electrical constitution of the ink-jet printer according to the embodiment 1 of the present invention.

Next, electric constitution of the ink-jet printer 1 will be described. As shown in FIG. 3, the ink-jet printer 1 comprises a printer controller 31 and a printing engine 32.

First, description will be made for the printer controller 31.

The printer controller 31 comprises: a sensor interface 33 (hereinafter referred to as sensor I/F 33) for receiving head temperature information from the above-described temperature sensor 14; an external interface 34 (hereinafter referred to as external I/F 34 ) for receiving various data from a host computer (not shown) and the like; RAM 35 for temporarily storing various data; a backup memory 36 including a holding function for stored information; a ROM 37 storing controlling program and the like; a control section 38 that is constituted by including such things as a CPU; an oscillation circuit 39 for generating a dock signal; a driving signal generating circuit 40 for generating a driving signal to be supplied to the recording head 11; a power source generating section 41 for generating the power source to be used in the driving signal generating circuit 40; and an internal interface 42 (hereinafter referred to as internal I/F 42) for transmitting a driving signal, dot pattern data (printing data), based on the printing data, and the like to the printing engine 32.

The sensor I/F 33 receives head temperature information that was detected by the temperature sensor 14 and converted into a digital quantity by an A/D converter 45 (analog/digital converter).

The external I/F 34 receives the printing data, which is constituted of, for example, a character code, a graphic function, image data and the like, from the host computer or the like. In addition, a busy signal (BUSY) and an acknowledge signal (ACK) are outputted to the host computer or the like via the external I/F 34.

The RAM 35 functions as a receiving buffer, an intermediate buffer, an output buffer and a working memory(not shown). The receiving buffer temporarily stores the printing data received via the external I/F 34 , the intermediate buffer stores intermediate code data converted by the control section 38, and the output buffer stores dot pattern data. The dot pattern data is constituted of the printing data that is obtained by decoding (translating) gradation data.

The backup memory 36 functions as the temperature information storing means or temperature information storing section of the present invention, and comprises a storing section 46 for storing the head temperature information obtained by the sensor I/F 33 and a power source supplies section 47 constitute of a secondary cell a capacitor and the like. The power source supplies section 47 functions as power source supply means, and supplies a backup power source to the storing section 46 in order to hold stored contents even during the time when the main power source is turned off.

Note that the backup memory 36 is not limited to the one constituted of the storing section 46 and the power source supply section 47, but may be constituted of non-volatile memory such as an EEPROM.

The ROM 37 stores a control program (control routine) for performing various data processing, font data, a graphic function and the like. The ROM 37 also functions as a signal adjustment information storing means, and stores driving signal adjusting data (signal adjustment information) for adjusting a driving voltage (wave height value) and the pulse form of a driving pulse constituting the driving signal according to the head temperature information value (ink temperature).

Note that the ROM 37 is made to be a rewritable memory such that various programs or driving signal adjustment data stored in the memory can be rewritten. Such programs for rewriting are read from a storing medium 43 such as a floppy disk and a CD-ROM, which are directly connected via the external I/F 34 or connected via the host computer.

Alternatively, the control program read from the storing medium 43 may be read into a non-volatile memory or the like that is provided separately from the ROM 37 and activated.

The control section 38 operates by activating various control programs stored in the ROM 37. The control section 38 reads out the printing data in the receiving buffer, and allows the intermediate buffer to store intermediate code data obtained by converting the read printing data, while it controls various controls. The control section 38 also analyzes intermediate code data read from the intermediate buffer, refers to the font data and the graphic function and the like, then develops the intermediate code data in the dot pattern data. And then, the control section 38 allows the output buffer to store the dot pattern data after necessary decoration processing is executed.

When the dot pattern data for one line that can be recorded by one main scan of the recording head 11 is recorded, the dot pattern data for the one line is sequentially outputted from the output buffer to the recording head 11 via the internal I/F 42. And, when the dot pattern data for one line is outputted from the output buffer, developed intermediate code data is deleted from the intermediate buffer, then development processing for the next intermediate code data is performed.

Figure 4:
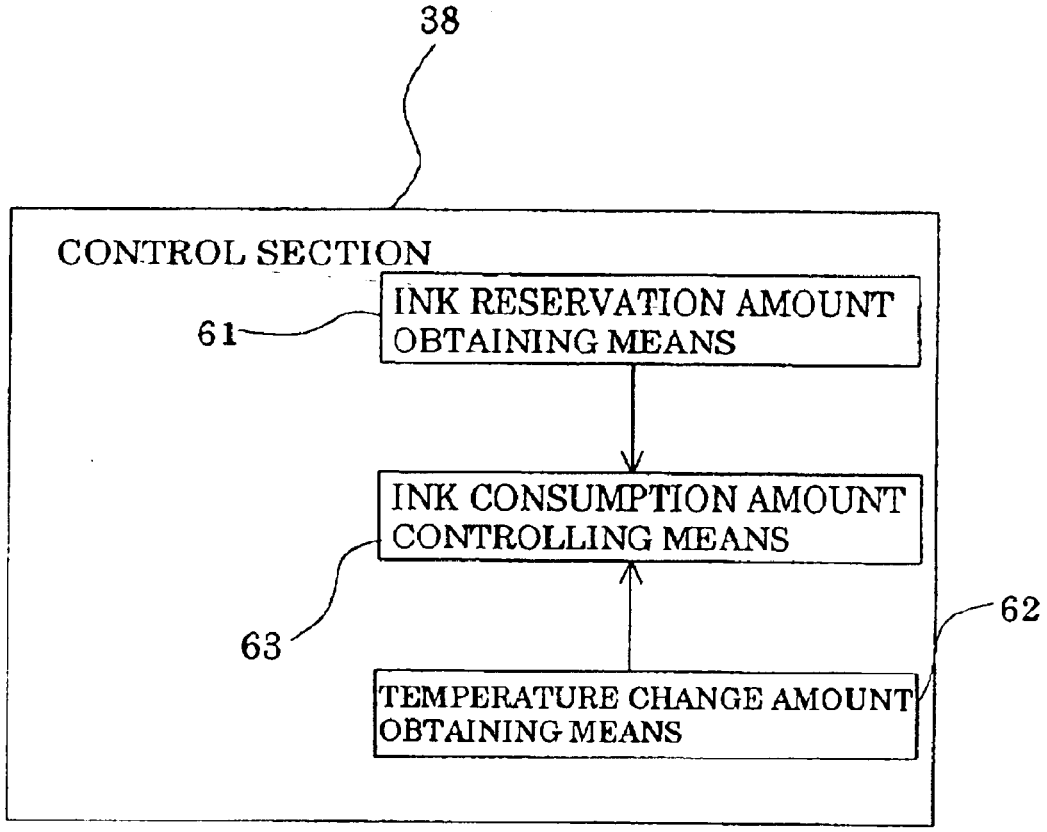
FIG. 4 is a block diagram explaining the constitution of a control section according to the embodiment 1 of the present invention.

As shown in FIG. 4, the control section 38, other than the above described constitution, comprises an ink reservation amount obtaining means 61, temperature change amount obtaining means 62 and ink consumption controlling means 63. It will be appreciated that these components may also be referred to as an ink reservation amount obtaining section, a temperature change amount obtaining section, and an ink consumption controlling section.

The ink reservation obtaining means 61 obtains the ink reservation amount (that is, the residual ink amount) of the ink cartridge 12 based on the consumption amount of ink via ink ejection by recording operation and flushing, and ink sucking by sucking operation.

For example, replacement of a new ink cartridge 12, ink refill into an ink tank or the like is recognized based on input signal from a maintenance switch (not shown), and the ink reservation amount information is reset when the ink cartridge 12 is replaced or ink refill into the ink tank is performed. Here, the ink reservation amount obtaining means 61 stores initial ink amount information as content of the ink cartridge 12 or filled-up content of the ink tank to the backup memory 36 as the ink reservation amount information.

Next, the ink reservation amount obtaining means 61 detects ink consumption amounts one by one that consist of ink ejection amount and ink sucking amount by the sucking operation, and obtains the ink reservation amount (residual ink amount) by subtracting the ink consumption amount from the initial ink amount information.

The temperature change amount obtaining means 62 performs control such that the head temperature information inputted from the temperature sensor 14 via A/D converter 45 is stored in the backup memory 36. For example, the head temperature information from the temperature sensor 14 is stored in the backup memory 36 every time when a certain period of time passes.

Then, the temperature change amount obtaining means 62 obtains the temperature change amount of the recording head 11 based on the head temperature information stored in the backup memory 36.

On the other hand, the ink consumption amount controlling means 63 controls the ink consumption amount of the recording head 11 . Note that the control of the ink consumption amount by the ink consumption amount controlling means 63 is basically control of the ink consumption amount accompanied with ink ejection at recording operation or preparatory ejection operation.

Here, control of the ink consumption amount accompanied with ink ejection is selecting spaced adjustment data from the driving signal adjustment data stored in the ROM 37 according to the temperature change amount of the recording head 11 obtained by the temperature change amount obtaining means 62 and the ink reservation amount of the ink cartridge 12 obtained by the ink reservation amount obtaining means 61, and outputting control signal (driving signal adjustment information) to the driving signal generating circuit 40 based on the adjustment data. With this control, the ink amount ejected from the recording head 11 is controlled to be substantially constant regardless of the volume of the temperature change amount.

As described above, since the ink amount ejected from the recording head 11 is controlled to be constant by the ink consumption amount controlling means 63, the amount of ejected ink can be accurately obtained by counting the number of ejections. Therefore, the ink reservation amount obtaining means 61 can accurately obtain the ink reservation amount in the ink reservoir by grasping the ejection amount of the recording operation, the ejection amount of flushing and the sucked amount of the sucking operation.

Also, since the ink reservation amount in the ink reservoir can be accurately grasped by controlling the ink consumption amount, wasted replacement of the ink cartridge 12 is prevented in a state where ink is still remaining in the cartridge in the case of replacing the ink cartridge 12, and ink temperature in the ink reservoir can be easily estimated.

Note that the ink consumption amount controlling means 63 may control the ink sucking amount in the sucking operation. The control of the ink sucking amount by the ink consumption amount controlling means 63 is adjusting ink sucking speed and ink sucking time by controlling the sucking means according to the temperature change amount obtained by the temperature change amount obtaining means 62 and the ink reservation amount obtained by the ink reservation amount obtaining means 61. With this adjustment, the ink sucking amount in the sucking operation is controlled to be a specified amount constantly. As described above, by controlling the ink sucking amount in the sucking operation to be constant, the ink reservation amount in the ink reservoir obtained by the ink reservation amount obtaining means 61 can be obtained more accurately.

Figure 7:
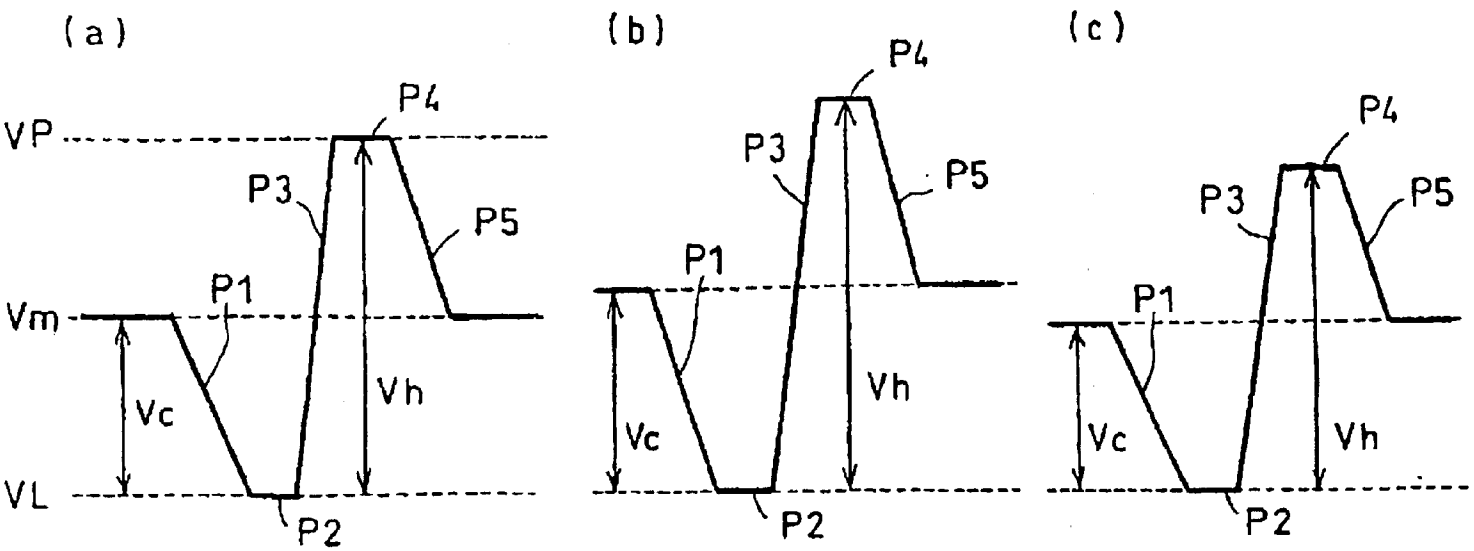
FIGS. 7(*a*) to 7(*c*) are views explaining a pulse form constituting a driving signal according to the embodiment 1 of the present invention.

Here, the driving signal generating circuit or section 40 functions as the driving signal generating means in the present invention, and generates a driving signal for working the piezoelectric element 23 of the recording head 11. For example, the circuit generates a driving signal (COM) in which a plurality of driving pulses are connected in series as shown in FIG. 7(*a*).

The exemplified driving pulse is constituted of: an expansion element (discharge pulse) P1 in which electric potential changes by descending from the middle potential Vm to the lowest potential VL in a constant slope; a first holding element (holding pulse) P2 that holds the lowest potential VL; an ejection element (charge pulse) P3 in which electric potential ascends from the lowest potential VL to the highest potential VP in a specified slope; a second holding element P4 that holds the highest potential VP; and a damping element P5 in which electric potential changes by descending from the highest potential VP to the middle potential Vm in a specified slope.

The above-described expansion element P1 is applied to the piezoelectric element 23, the piezoelectric element 23 deforms in the direction that it expands the volume of the pressure chamber 24, and generates a negative pressure in the pressure chamber 24. The expansion state of the pressure chamber 24 is held during the period while the first holding element P2 is being applied. The ejection element P3 is supplied followed by the first holding element P2. When the first holding element P2 is supplied, the piezoelectric element 23 deforms such that the pressure chamber 24 contracts. The contraction of the pressure chamber 24 allows ink pressure in the pressure chamber 24 to increase, and ink droplets are ejected from the nozzle orifice 13. The contraction state of the pressure chamber 24 is held during the period while the second holding element P4 is being applied. Thereafter, the damping element P5 is supplied to the piezoelectric element 23 in order to terminate vibration of a meniscus (free surface of ink exposed at the nozzle orifice 13) in a short time.

The driving signal generating circuit 40 also generates a driving signal that is adjusted into a control signal (driving signal adjustment information) outputted from the control section 38. For example, the circuit 40 increases/decreases driving voltage (wave height value) Vh and generates a driving signal of which the pulse form is adjusted. Note that the adjustment of the driving signal will be described later.

Next, description will be made for the printing engine 32.

The printing engine 32 is constituted of a paper feeding motor 50, the pulse motor 7 and an electric driving system 51 of the recording head 11.

The electric driving system 51 of the recording head 11 comprises a shift register circuit 52, a latching circuit 53, a level shifter circuit 54, a switching circuit 55 and the piezoelectric element 23, and they are electrically connected in the order of the shift register circuit 52, the latching circuit 53, the level shifter circuit 54, the switching circuit 55 and the piezoelectric element 23. The shift register circuit 52, the latching circuit 53, the level shifter circuit 54, the switching circuit 55 and the piezoelectric element 23 are provided in plural numbers corresponding to the respective nozzle orifice 13 of the recording head 11.

In the electric driving system 51, when the printing data added to the switching circuit 55 is "1", the switching circuit 55 is in a connection state, and the driving signal (COM) is directly applied to the piezoelectric element 23, and then each piezoelectric element 23 deforms according to pulse form (electric potential) of the driving signal. On the contrary, when the printing data added to the switching circuit 55 is "0", the switching circuit 55 is in a non-connection state, and supply of a driving signal to the piezoelectric element 23 is cut off.

As described above, since the driving signal can be selectively supplied to each piezoelectric element 23 based on the printing data, ink droplets can be selectively ejected from the nozzle orifice 13 depending on the method of giving the printing data.

Next, description will be made for the operation of the ink-jet printer 1 paying attention mainly to the adjustment of the driving signal based on the temperature change amount of the recording head 11 and the ink reservation amount of the ink cartridge 12.

Figure 5:
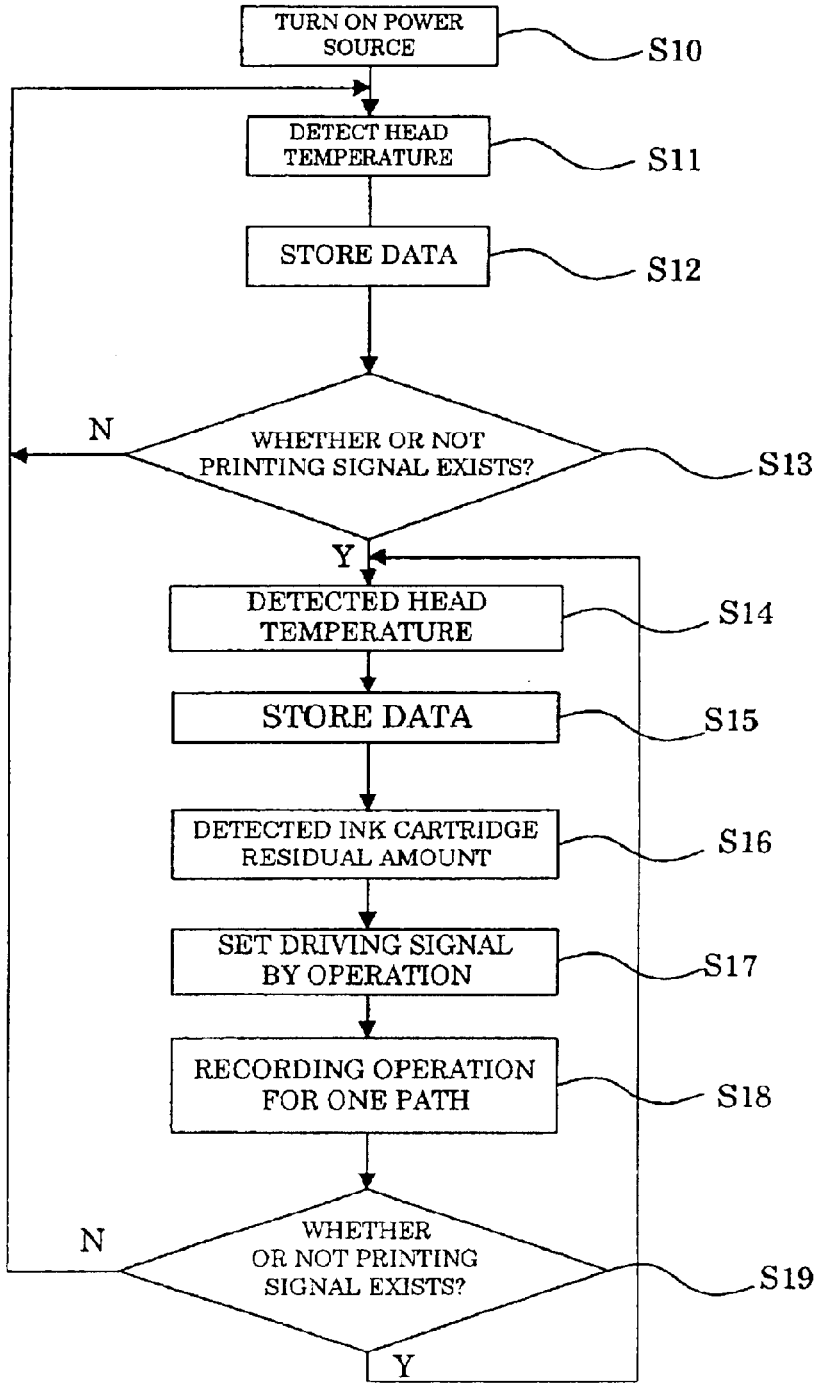
FIG. 5 is a flowchart explaining the operation of the ink-jet printer according to the embodiment 1 of the present invention.
Figure 6:
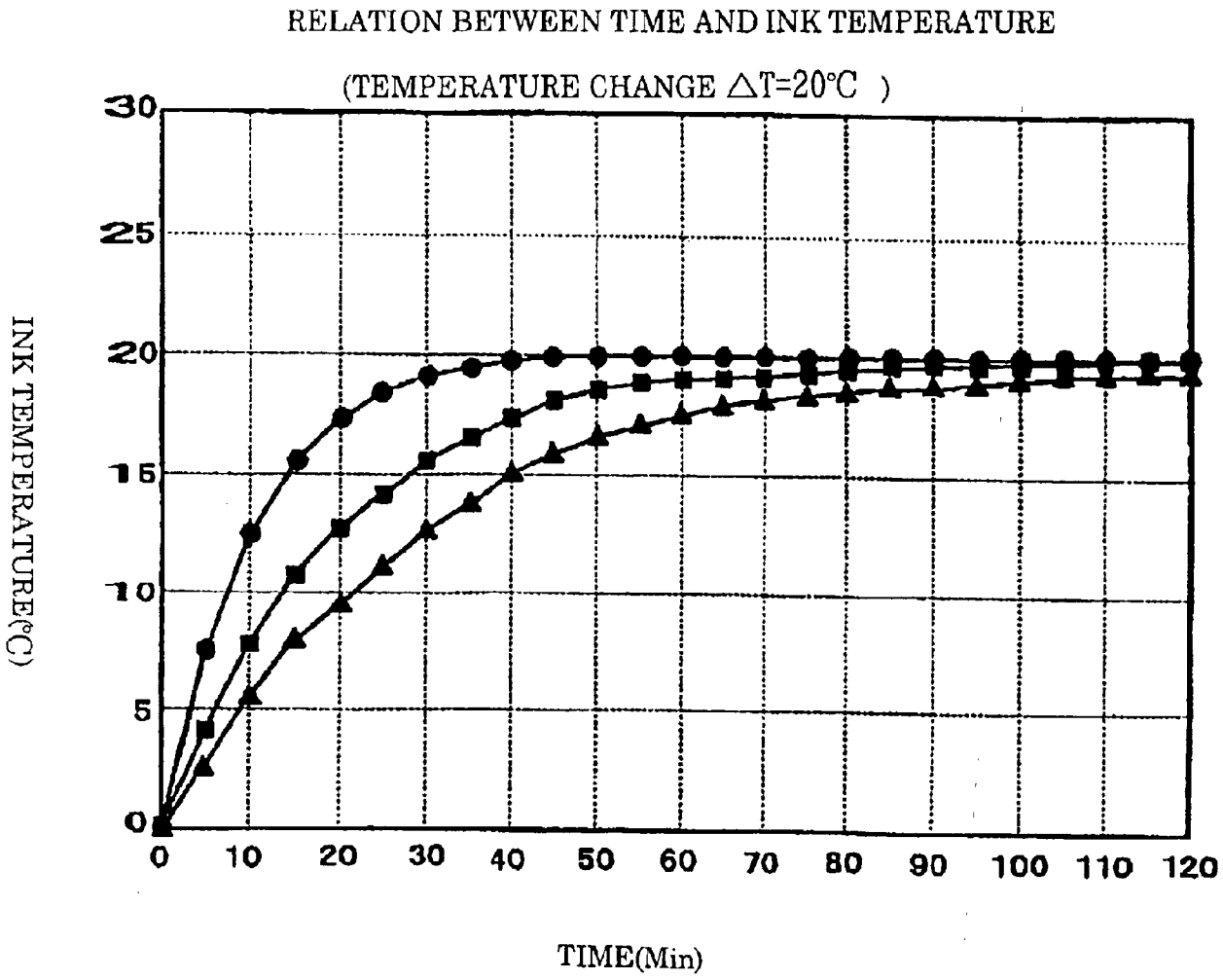
FIG. 6 is a graph illustrating the relation between leaving time and ink temperature in an ink cartridge according to the embodiment 1 of the present invention.

FIG. 5 is a flowchart explaining the operation of the ink-jet printer 1, FIG. 6 is a view explaining the difference of change of ink temperature accompanied with the ink reservation amount (residual ink amount), and FIG. 7 is a view explaining a driving pulse constituting a driving signal.

When the power source is turned on to the ink-jet printer 1 (S10), the temperature change amount obtaining means 62 obtains the head temperature information detected by the temperature sensor 14 (S11), and the obtained head temperature information is stored in the backup memory 36 that is the temperature information storing means (S12). In this embodiment, the head temperature information from the time when the power source is turned on is stored in the backup memory 36 as described above.

Obtaining processing and storing processing of the head temperature information are iterated at a specified time (for example, every one minute) until the printing data (printing signal) from the host computer is received (S13). Accordingly, the head temperature information in a waiting state, where no recording operation is performed, is stored in the backup memory 36 every specified time.

Upon receiving the above-described printing data, the temperature change amount obtaining means 62 obtains the head temperature information from the temperature sensor 14 (S14), and stores the obtained head temperature information in the backup memory (S15). Thereafter, the ink reservation amount obtaining means 61 obtains the ink reservation amount (residual ink amount) (S16). The ink reservation amount is obtained, for example, by subtracting the ink ejection amount from the initial ink amount information.

After the ink reservation amount is obtained, the ink consumption controlling means 63 performs adjustment of the driving signal (S17).

In the processing of step S17, the temperature change amount obtaining means 62 firstly obtains the temperature change amount of the recording head 11, for example, the change amount of the head temperature information corresponding to a unit time, based on the head temperature information stored in the backup memory 36 (temperature information storing means).

Various methods can be used in order to obtain the temperature change amount. For example, the temperature change amount may be calculated by using the head temperature information obtained immediately after the power source was turned on and the latest head temperature information. Alternatively, the temperature change amount may be calculated via the method of least squares by using a plurality of head temperature information between the head temperature information before a specified time and the latest head temperature information.

Upon obtaining the temperature change amount, the ink consumption amount controlling means 63 estimates the temperature of ink reserved in the ink cartridge 12 (or ink tank). In this processing, the control section 38, by adding the temperature change amount and the ink reservation amount to the latest head temperature information, estimates the current ink temperature.

Note that the temperature change amount of the recording head obtained by the temperature change amount obtaining means 62 is a value that is obtained by subtracting the preceding estimated ink temperature from the present head temperature detected by the temperature sensor 14.

If there is no information of the preceding estimated ink temperature, as in the case where the ink cartridge 12 is replaced or the power source is turned on, the present head temperature is used as it is as the ink temperature.

Here, the fact that the temperature change amount is large per unit time means that the environmental temperature (room temperature) at a place where the ink-jet printer 1 is used is largely changed in a short time. It is noted that the temperature changing speed of ink is slower than that of environmental temperature due to the difference of the heat capacity Therefore, when the temperature change amount per unit time is large, the ink temperature is estimated by taking into account that the ink temperature changes more slowly than the head temperature information. For example, in the case where the temperature change amount per unit time is large in the positive direction (+direction), the ink temperature is set lower than that of the latest head temperature information according to the temperature change amount because in this case, the state is that the temperature of the recording head 11 (that is, the environmental temperature) is rapidly increased. Conversely, in the case where the temperature change amount per unit time is large in the negative direction (−direction), the ink temperature is set higher than that of the latest head temperature information according to the temperature change amount.

On the other hand, the fact that the above-described temperature change amount is constant for a relatively long time (for example approximately one to two hours) means that the environmental temperature is stable under a certain temperature. In such a case, since it is presumed that the ink temperature is substantially the same as the environmental temperature, the ink temperature is made coincident with the latest head temperature information.

Degree of ink temperature change relative to environmental temperature differs depending on the ink reservation amount.

Here, FIG. 6 is a graph showing change of the ink temperature with the passage of time in the case where three pieces of the ink cartridges 12 with different ink reservation amounts were cooled down until ink temperature reached 0° C. and each ink cartridge 12 was left to stand in an environment of 20° C. In FIG. 6, a line segment added with a "triangle" code shows a state where ink is filed in a cartridge, a line segment added with a "square" code shows a state where the ink reservation amount is substantially half of the cartridge volume, and a line segment added with a "circle" code shows a state that the ink reservation amount is about one third the cartridge volume.

As it is understood from FIG. 6, the less the ink reservation amount in the ink cartridge is, the faster the ink temperature ascends to the environmental temperature. For example, in the ink cartridge 12 with ink about one third the cartridge volume, the ink temperature ascended to the same degree as the environmental temperature in about thirty minutes after the cartridge was left to stand. On the contrary, in the ink cartridge 12 with ink about a half the cartridge volume, about sixty minutes were needed until the ink temperature ascended to the same degree as the environmental temperature, and about ninety minutes were needed for the ink cartridge 12 in which ink was filled.

As described above, the more the ink reservation amount is, the slower the ink temperature changes. Conversely, the less the ink reservation amount is, the faster the ink temperature changes. Therefore, the less the ink reservation amount is, the closer the ink temperature is set to the latest head temperature information.

Note that, in the embodiment, the relation between the above-described temperature change amount and the ink reservation amount is stored in the ROM 37, for example, as table information (ink temperature estimation information) as shown in the following table 1.

TABLE 1

| Temperature change ratio | Residual ink amount (%) | | | | | | | | | | |
|---|---|---|---|---|---|---|---|---|---|---|---|
| (° C./min) | 0 | 10 | 20 | 30 | 40 | 50 | 60 | 70 | 80 | 90 | 100 |
| −20.00 | 0.00 | 0.72 | 0.85 | 0.89 | 0.92 | 0.94 | 0.95 | 0.95 | 0.96 | 0.96 | 0.97 |
| . | . | . | . | . | . | . | . | . | . | . | . |
| . | . | . | . | . | . | . | . | . | . | . | . |
| . | . | . | . | . | . | . | . | . | . | . | . |
| −2.0 | 0.00 | 0.04 | 0.08 | 0.12 | 0.12 | 0.16 | 0.16 | 0.16 | 0.20 | 0.20 | 0.20 |
| −1.5 | 0.00 | 0.03 | 0.06 | 0.06 | 0.09 | 0.09 | 0.12 | 0.12 | 0.15 | 0.15 | 0.15 |
| −1.0 | 0.00 | 0.02 | 0.04 | 0.04 | 0.06 | 0.06 | 0.08 | 0.08 | 0.10 | 0.10 | 0.10 |
| −0.5 | 0.00 | 0.01 | 0.02 | 0.02 | 0.03 | 0.03 | 0.04 | 0.04 | 0.05 | 0.05 | 0.05 |
| 0.0 | 0.00 | 0.00 | 0.00 | 0.00 | 0.00 | 0.00 | 0.00 | 0.00 | 0.00 | 0.00 | 0.00 |
| 0.5 | 0.00 | −0.01 | −0.02 | −0.02 | −0.03 | −0.03 | −0.04 | −0.04 | −0.05 | −0.05 | −0.05 |
| 1.0 | 0.00 | −0.02 | −0.02 | −0.04 | −0.06 | −0.06 | −0.08 | −0.08 | −0.10 | −0.10 | −0.10 |
| 1.5 | 0.00 | −0.03 | −0.06 | −0.06 | −0.09 | −0.09 | −0.12 | −0.12 | −0.15 | −0.15 | −0.15 |
| 2.0 | 0.00 | −0.04 | −0.06 | −0.08 | −0.12 | −0.12 | −0.16 | −0.16 | −0.20 | −0.20 | −0.20 |
| . | . | . | . | . | . | . | . | . | . | . | . |
| . | . | . | . | . | . | . | . | . | . | . | . |
| . | . | . | . | . | . | . | . | . | . | . | . |
| 10.0 | 0.00 | −0.72 | −0.85 | −0.89 | −0.92 | −0.94 | −0.95 | −0.95 | −0.96 | −0.96 | −0.97 |

By using such table information, the ink temperature T is calculated in the following expression from: the head temperature Tt detected by the temperature sensor 14; the adjustment coefficient k stored as table information as described above; and the temperature change amount ΔT obtained by the temperature change amount obtaining means 62.

$$T=Tt+k\Delta T \qquad \text{Expression 1}$$

For example, when the preceding adjusted temperature is 10° C., the present head temperature Tt detected by the temperature sensor 14 is 20° C., and the temperature change amount ΔT obtained by the temperature change amount obtaining means 62 is 1.0° C./min., the calculated ink temperature is 19° C. because the adjustment coefficient k is −0.10 when the residual ink amount detected by the ink reservation amount obtaining means 61 is 100%. On the other hand, when the residual ink amount is 30%, the adjustment coefficient k is −0.04, then the calculated ink temperature is 19.6° C.

In the embodiment, although the ink temperature is estimated by a calculation from the adjustment coefficient based on the above-described table information, the embodiment is not limited to this. The ink temperature T may be calculated, for example, in the following expression from: the head temperature Tt detected by the temperature sensor 14; the preceding adjusted temperature TO; and the constant α.

$$T=Tt+(TO+Tt)\exp(-\alpha/C\cdot t) \qquad \text{Expression 2}$$

After the ink temperature is estimated in such a manner, the driving pulse form is adjusted based on the ink temperature. In other words, the pulse form of driving voltage Vh (wave height value) of a driving pulse is changed according to the ink temperature.

In this case, the ink consumption amount controlling means 63 refers to driving signal adjusting data. When the ink temperature is lower than a standard temperature, driving voltage Vh of a driving pulse is set higher than a reference driving voltage [(driving voltage Vh of a driving pulse in FIG. 7(*a*)] in order to make the ejecting force for ink droplets stronger than usual. On the contrary, when the ink temperature is higher than a standard ink temperature, driving voltage Vh of a driving pulse is set lower than a reference driving voltage as shown in FIG. 7(*c*) in order to make the ejecting force for ink droplets weaker than usual.

Incidentally, when the ejecting force for ink droplets is changed as described above, the flying speed of ink droplets also changes according to the degree of the ejecting force. For example, when driving voltage Vh is set higher than a reference driving voltage, the flying speed of ink droplets becomes faster than the reference flying speed, and when driving voltage Vh is set lower than a reference driving voltage, the flying speed of ink droplets becomes slower than the reference flying speed.

In the embodiment, the flying speed of ink droplets is made to be coincident with a standard speed by adjusting the pulse form as well.

Figure 8:
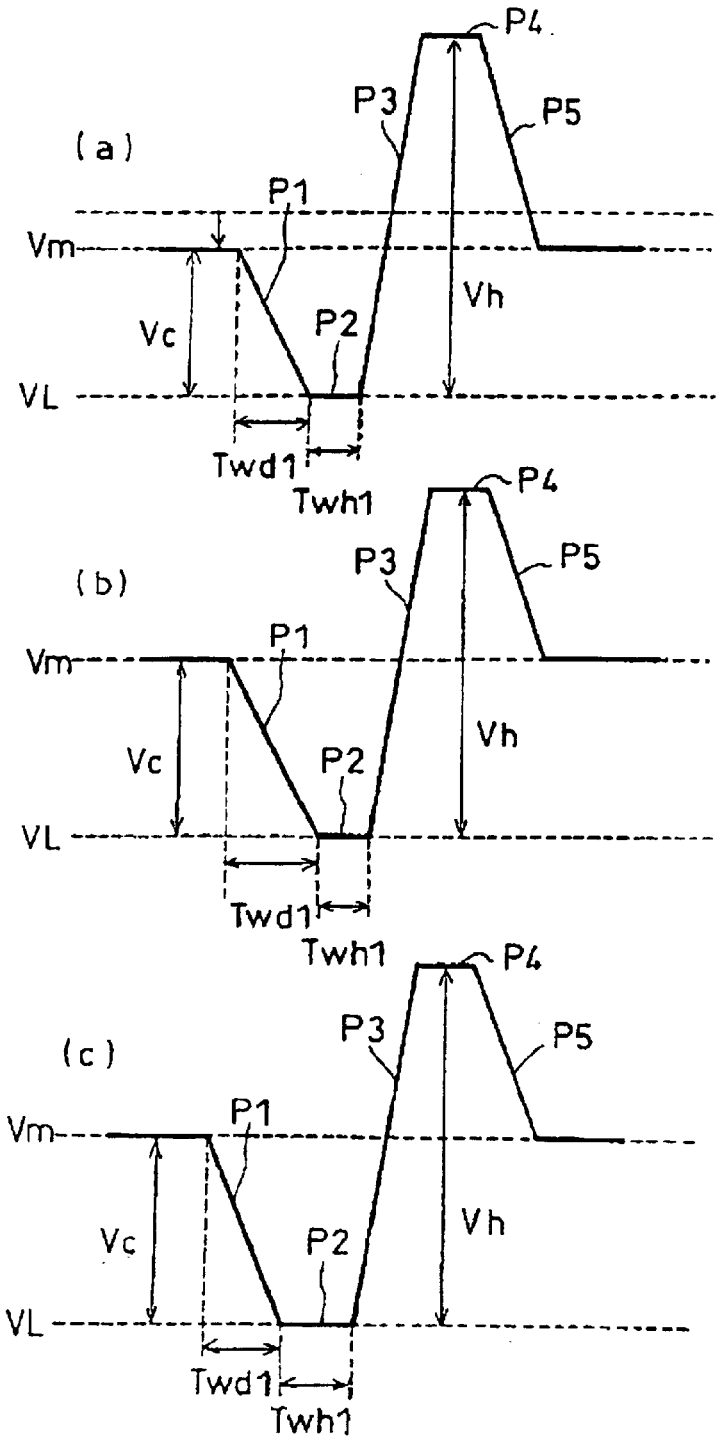
FIGS. 8(*a*) to 8(*c*) are views explaining the adjustment of a driving signal according to the embodiment 1 of the present invention.

In the case where driving voltage Vh is set higher than a reference driving voltage, adjustment of the driving pulse as exemplified in FIG. 8(*a*) to (*c*) is performed in order to decrease the flying speed of ink droplets. In other words, in FIG. 8(*a*), intermediate voltage (Vc) is made smaller than a reference intermediate potential [intermediate potential Vm of a driving pulse in FIG. 7(*a*)] by decreasing intermediate potential Vm. In FIG. 8(*b*), voltage slope of the expansion element P1, which allows the pressure chamber 24 to expand, is set gently. In other words, the supply time Twd1 of the expansion element P1 is set longer than the standard supply time. In FIG. 8 (*c*), the first holding element P2 (time component Twh1) for holding the expansion state of the pressure chamber 24 is set longer than the standard time.

Figure 9:
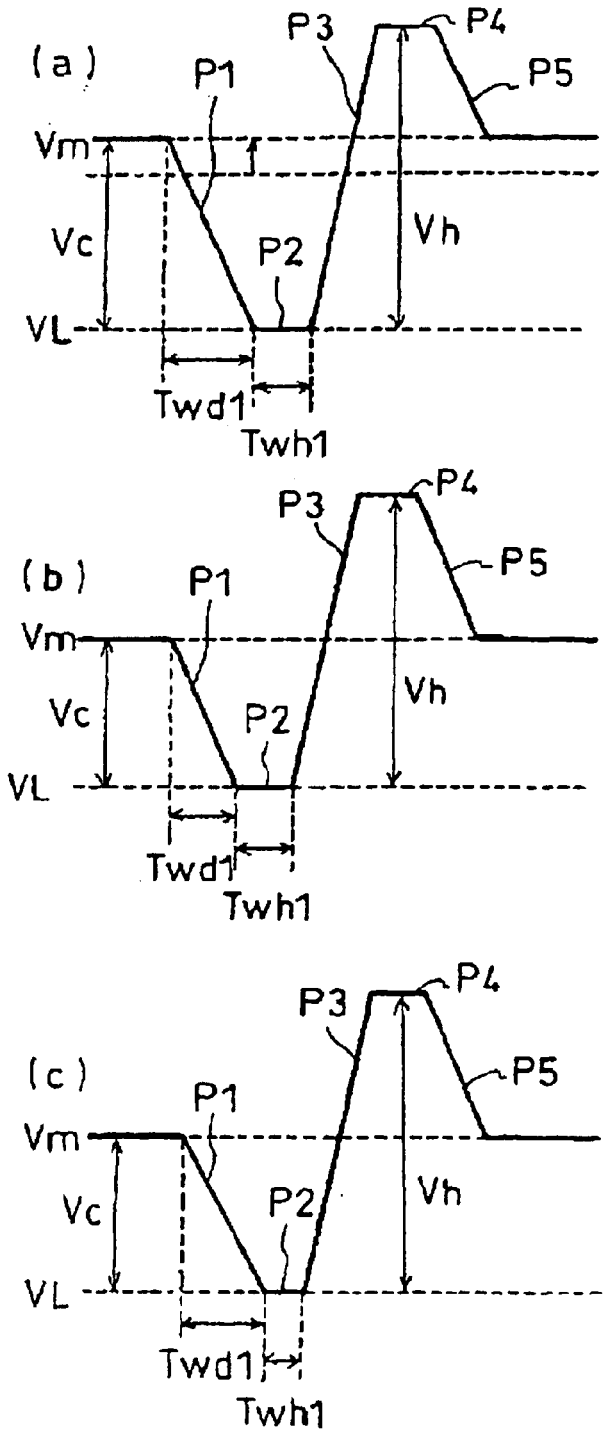
FIGS. 9(*a*) to (*c*) are views explaining the adjustment of a driving signal of the embodiment 1 of the present invention.

On the other hand, in the case where driving voltage Vh is set lower than a reference driving voltage, adjustment as shown in FIGS. 9(*a*) to (*c*) is performed in order to increase the flying speed of ink droplets. In other words, in FIG. 9(*a*), intermediate voltage (Vc) is made larger than a reference intermediate potential [intermediate potential Vm of a pulse form in FIG. 9 (*a*)] by increasing intermediate potential Vm. In FIG. 9(*b*), voltage slope of the expansion element P1, which allows the pressure chamber 24 to expand, is set steep. In other words, the supply time Twd1 of the expansion element P1 is set shorter than the standard supply time. In FIG. 9 (*c*), the first holding element P2 (time component Twh1) for holding the expansion state of the pressure chamber 24 is set shorter than the standard time.

Note that, in the driving signal adjustment processing of the step S17, although the ink consumption amount control means 63 estimates the ink temperature based on the temperature change amount and the ink reservation amount, thus a driving pulse form is adjusted based on the ink temperature, the adjustment is not limited to this method. Specifically, it is satisfactory that the ink consumption amount accompanied with ink ejection is controlled by setting an appropriate driving signal based on the temperature change amount and the ink reservation amount.

For example, a constitution may be taken such that each information of the latest temperature change amount, the temperature change amount per unit time and the ink reservation amount and parameter for defining a driving pulse form (for example, an intermediate potential, a supply time Twd1 of the expansion element, a supply time Twh1 of the holding element, a driving voltage Vh and the like) are arranged in a table and stored in the ROM 37, and the driving signal is adjusted based on each information described above.

After the driving signal was adjusted as described above, recording operation for one path (for one line) is performed by using the adjusted driving signal (S18). In the recording operation, since ink droplets are ejected by using a driving pulse of which the driving voltage is adjusted according to the ink temperature, the ejected amount of ink droplets can be made constant even in a state where a temperature change amount per unit time is large such that environmental temperature is rapidly changed. Accordingly, image quality of a recorded image can be stabilized.

After recording for one path is completed, judgment is made for existence of printing data of the following line (S19). Here, when printing data of the following line exists, processing proceeds to step S14 described above for iterating the above-described recording operations (S14 to S19). On the other hand, when no printing data exists, processing proceeds to step S11, and the head temperature information in a waiting state is obtained every specified time until printing data is received (S11 to S13).

In the embodiment, the temperature of the recording head 11 is stored every specified time from the time when the power source is turned on, adjustment of the driving signal is performed based on the temperature change amount, and the ink reservation amount prior to printing for one line. Therefore, an appropriate driving signal can be set for every recording of every line, thus an image of stable image quality can be recorded even if room temperature is rapidly changed.

In addition, since the amount of ink droplets can be made constant regardless of the change of environmental temperature, the ink reservation amount can be accurately grasped. As a result, a blank printing phenomenon that printing operation is performed despite that ink in the ink cartridge 12 or the ink tank ran out, or a failure of replacement order for a cartridge or ink filling order is made despite that sufficient ink is reserved in the ink cartridge 12 or the ink tank can be surely prevented.

Note that, in the embodiment, although adjustment of the driving signal based on the temperature change amount and the ink reservation amount is performed prior to recording for one line, the adjustment timing is not limited to this. For example, the driving signal may be adjusted prior to recording for one page.

Additionally, the obtaining interval for the head temperature information is set at one minute. But, not limited to this, the interval may be set at an optional time. For example, the head temperature information may be obtained every ten minutes.

Further, regarding the ink reservation amount, obtaining of the ink reservation amount will suffice. Thus, a residual ink amount sensor for directly detecting ink amount in the ink cartridge 12 is provided, and the ink reservation amount may be detected based on a detecting signal from the residual ink amount sensor. Alternatively, with regards to resetting the ink reservation amount, a cartridge sensor for detecting mounting of the ink cartridge 12 is provided on carriage 2, replacement performance of the ink cartridge 12 is detected based on a detecting signal from the cartridge sensor, and the ink reservation amount may be automatically reset accompanied with the replacement.

Incidentally, in the above-described embodiment, the temperature change amount is obtained by using the head temperature information after the power source of the ink-jet printer 1 is turned on, and adjustment of the driving signal is performed. However, in the case where the power source is turned on again in a relatively short time after the power source of the ink-jet printer 1 is turned off, adjustment of the driving signal can be performed in a higher accuracy by using the head temperature information that was stored until then.

Figure 10:
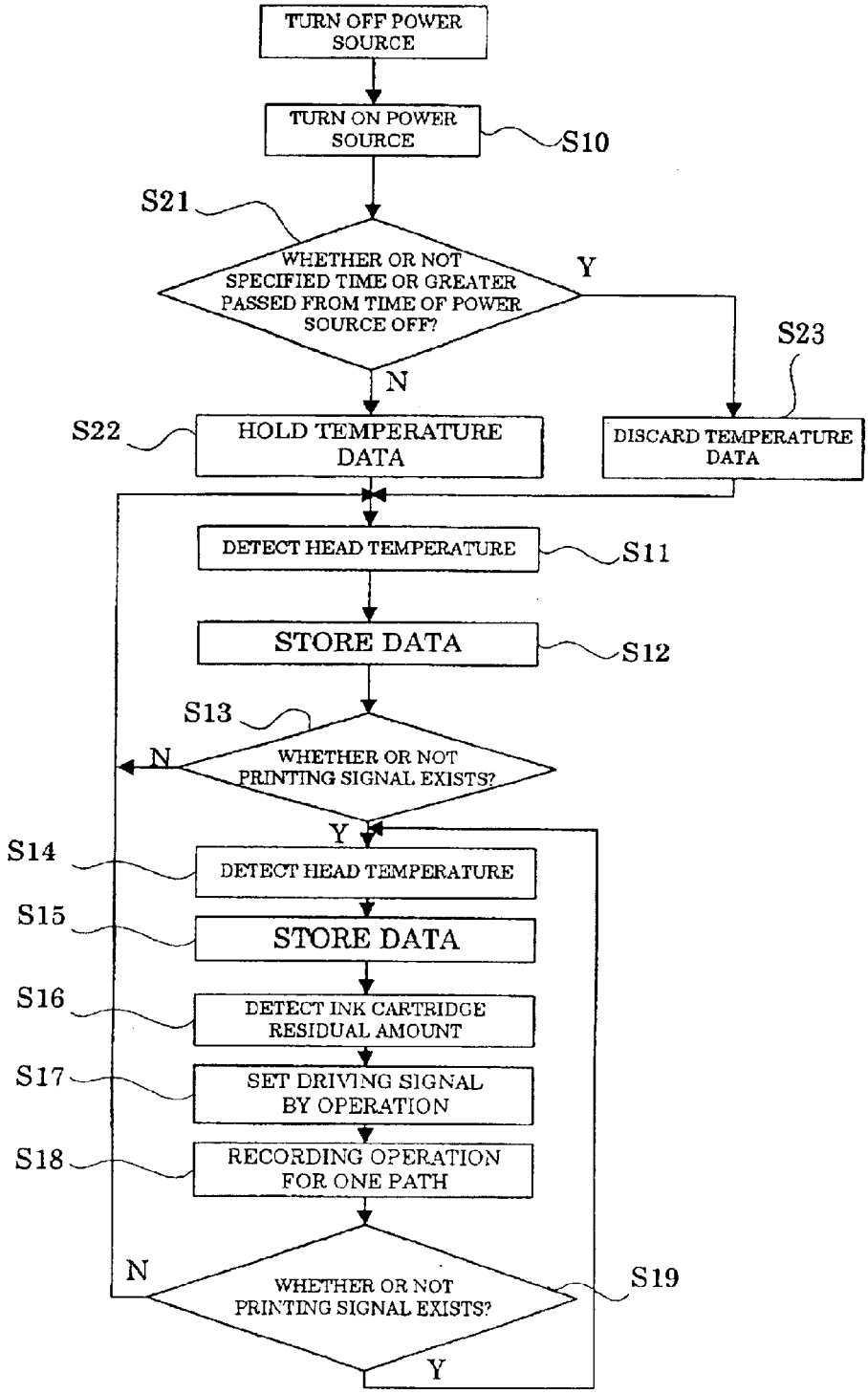
FIG. 10 is a flowchart explaining the operation of an ink-jet printer according to another example of the embodiment 1 of the present invention.

Next, description will be made for another embodiment constituted as described above. FIG. 10 is a flowchart explaining an operation of the ink-jet printer 1 in the embodiment. Note that, in the flowchart, the same step number is added to the same processing as that of the preceding embodiment (FIG. 5).

When the power source to the ink-jet printer 1 is turned on (S10), the control section 38 judges whether a specified time (for example ten minutes) from the preceding turning off point of the power source passed or not (S21).

The judgment is performed, for example, based on measurement information from a timer (not shown). The timer functions as a disconnection time measuring means, operates by an exclusive power source such as a secondary cell, thus the timer performs measurement operation during the time when the power source of the ink-jet printer 1 is turned off.

The control section 38 obtains measurement information from the timer immediately before the power source is turned off, and stores the obtained measurement information in the backup memory 36. Then, the control section 38 also obtains measurement information from the timer the next time the power source is turned on, a passage time from the preceding turning off point of the power source is obtained by comparing measurement information at the turning off point of the power source that is stored in the backup memory 36 with measurement information at the turning on point of the power source that is obtained this time.

In the case where obtained passage of time is a specified time or less, in other words, a main power source is turned on in a short time after the main power source of the ink-jet printer 1 was turned off, the head temperature information is obtained from the temperature sensor 14 (S11) while the head temperature information stored in the backup memory 36 is being held (S22). And then, the obtained temperature information is stored in the backup memory 36 as the temperature information storing means (S12 ). Therefore, in this case, the head temperature information after the power source is turned on is stored in the backup memory followed by the already obtained head temperature information.

Upon receiving the printing data (S13), the control section 38 obtains the head temperature information (S14), stores it to the backup memory 36 (S15), and obtains the ink reservation amount (S16).

After the ink reservation amount is obtained, the ink consumption amount controlling means 63 adjusts the driving signal (S17). In the adjustment processing, the control section 38 (temperature change amount obtaining means) obtains the temperature change amount by using the head temperature information obtained a little before the power source is turned on in addition to the head temperature information obtained after the power source is turned on. Then, the driving signal is adjusted based on the temperature change amount obtained in such a manner. Accordingly, a more accurate temperature change amount can be obtained. Thus, adjustment of the driving signal can be performed even more appropriately.

After the driving signal is adjusted, the recording operation is performed (S18), judgment is made whether or not there is next printing data (S19), and the above-described processing (processing from S11, or from S14) is iterated according to the judgment result On the other hand, in the above-described processing of step S21, when it is judged that a passage of time exceeded a specified time, the head temperature information stored in the backup memory 36, that is, the head temperature information obtained prior to turning off the power source is cleared (S23). Then, the processing proceeds to step S11 to perform the above-described processing. In this case, the operation will be the same as that of the above-described embodiment.

As it has been described, in the embodiment, in the case where the power source is turned on again in a relatively short time after the main power source of the ink-jet printer 1 was turned off, the driving voltage is adjusted by using the head temperature information obtained before the power source was turned off. With this adjustment, when the power source is turned on again after a relatively short time, adjustment of the driving signal can be performed by using more head temperature information. As a result, adjustment of the driving pulse form can be performed more appropriately, and further stabilization of image quality can be achieved.

Incidentally, each of the above embodiments has a constitution such that the head temperature information is obtained every specified time, which begins from the time when the power source of the ink-jet printer 1 is turned on. The head temperature information may be obtained with the recording operation.

Figure 11:
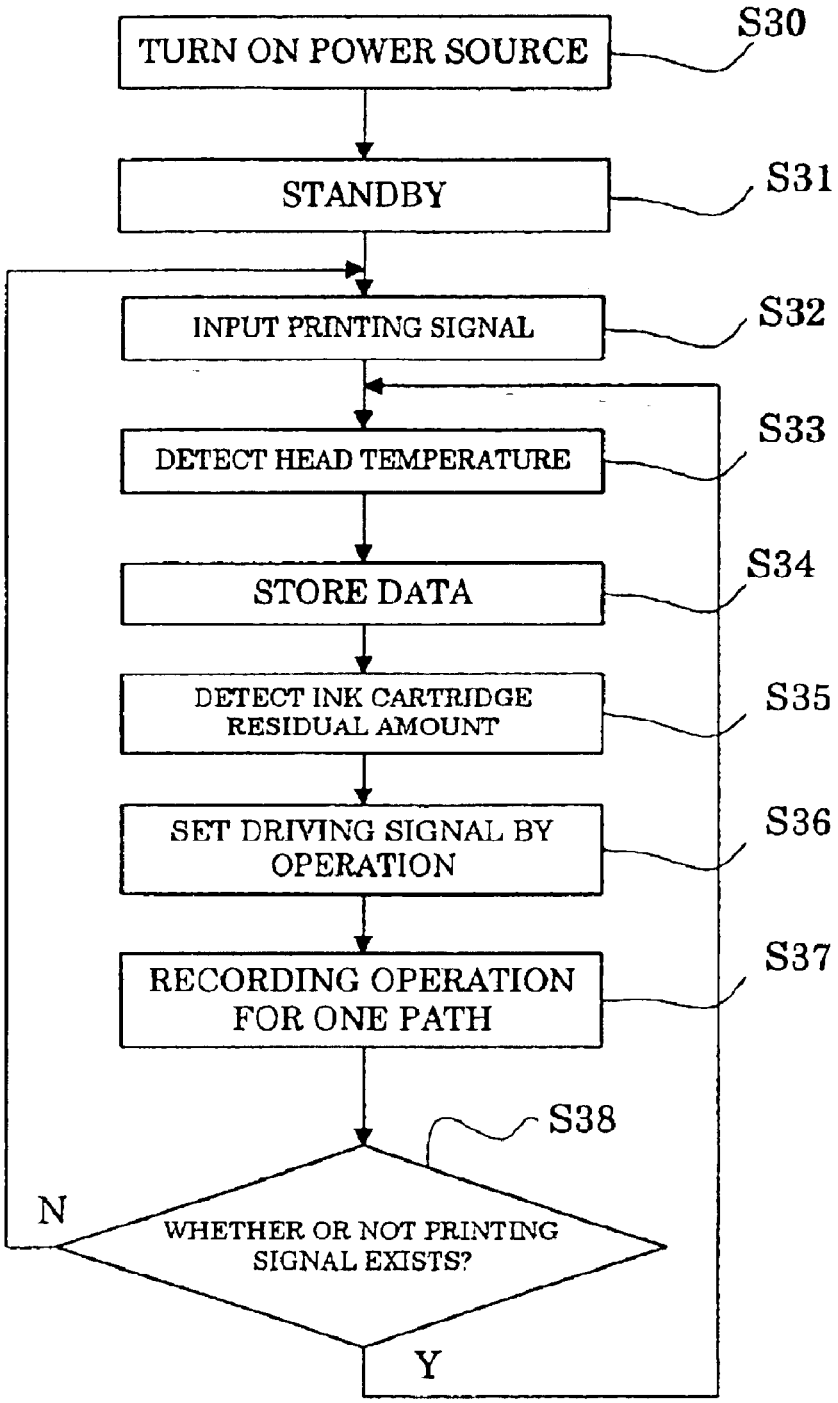
FIG. 11 is a flowchart explaining the operation of an ink-jet printer in another example of the embodiment 1 of the present invention.

Next, description will be made for another embodiment constituted as described above with reference to the flowchart in FIG. 11.

When the power source is turned on to the ink-jet printer 1 (S30), processing proceeds to a standby state (S31). On the standby state, the control section 38 obtains the head temperature information from the temperature sensor 14 as initial temperature information, and stores the obtained head temperature information in the backup memory 36 as the temperature information storing means.

Thereafter, the control section 38 monitors the printing data, and waits until the printing data is received (S32). Upon receiving the printing data, the control section 38 obtains the head temperature information (S33), and stores the obtained head temperature information in the backup memory 36 (S34).

After the head temperature information is stored in the backup memory 36, the control section 38 obtains the ink reservation amount (residual ink amount) in the ink cartridge 12 (S35), and adjusts the driving signal (S36). In the adjustment processing, the temperature change amount of the recording head 11 is obtained based on the latest head temperature information and the head temperature information obtained before the latest information. Then, the driving signal is adjusted based on the obtained temperature change amount and the ink reservation amount. Note that, in the initial recording operation after turning on the power source of the ink-jet printer 1, the temperature change amount is obtained by using the head temperature information obtained in the standby state.

After the driving signal is adjusted, recording for one line is performed by the adjusted driving signal (S37). In this recording operation, recording is performed with an appropriate ink amount by considering the ink temperature, similar to each aforementioned embodiment.

When the recording operation is completed, the control section judges whether or not there is next printing data (S38), and iterates the above-described processing according to the judgment result. Here, when the next printing data does not exist, the processing proceeds to step S32 and waits until the next printing data is received. On the other hand, when the next printing data exists, the processing proceeds to step S33 to obtain the head temperature information, and the head temperature information obtained in step S34 is stored in the backup memory 36. And then, the driving pulse form is adjusted by using the obtained head temperature information (S36).

As described above, in the embodiment, every time the printing data is inputted, in other words, every time recording operation for one line is performed, the head temperature information is obtained prior to the recording operation, and the obtained head temperature information is stored in the backup memory 36 (temperature information storing means). Accordingly, when a constitution is made such that the head temperature information is obtained corresponding to the recording operation for one line and stored in the backup memory 36, the amount of the head temperature information to be stored in the backup memory 36 can be reduced while appropriately adjusting the driving signal.

Based on a similar conception, the head temperature information may be obtained prior to the recording operation every time recording for one page is executed to be stored in the backup memory 36.

Note that various additions and changes within the scope and the spirit of the present invention as described above can be made.

For example, the ink-jet recording apparatus of the present invention is not limited to an ink-jet recording apparatus including the piezoelectric element as a pressure generating element, and an ink-jet recording apparatus including a magnetostrictive element as a pressure generating element may be used.

Alternatively, a heating element may be used as a pressure generating element. A similar effect can be obtained in an ink-jet recording apparatus including a recording head that ejects ink droplets by expanding/contracting bubbles in the pressure chamber via heat generated by the heating element.

Moreover, in the above-described examples, the driving signal of a normal printing is adjusted based on the temperature change amount, but a flushing may be performed, which is performed before start of printing or during printing, by using the adjusted driving signal. Thus, an appropriate flushing can be performed in the driving signal suitable to actual ink temperature.

Embodiment 2

In the above-described embodiment 1, the ink consumption amount of the recording head during the recording operation is controlled based on the ink reservation amount and the temperature change amount of the recording head 11. In this embodiment 2, the ink consumption amount during the preparatory ejection operation (flushing) is controlled based on the ink reservation amount and the temperature change amount of the recording head.

The flushing implies the ejection of the ink of the nozzle orifice 13 and the vicinity thereof by ejecting the ink droplets in a state where the recording head 11 stops at an area other than the area where the recording head 11 opposes the recording paper 8, for example, at the waiting position during a specified time, for example, before the start of printing or an interval between printings, in order to solve such problems as generation of the plugging of the nozzle orifice which is caused by the increase of the ink viscosity due to the ink temperature change and the like accompanied with the environmental temperature of the printer.

Figure 12:
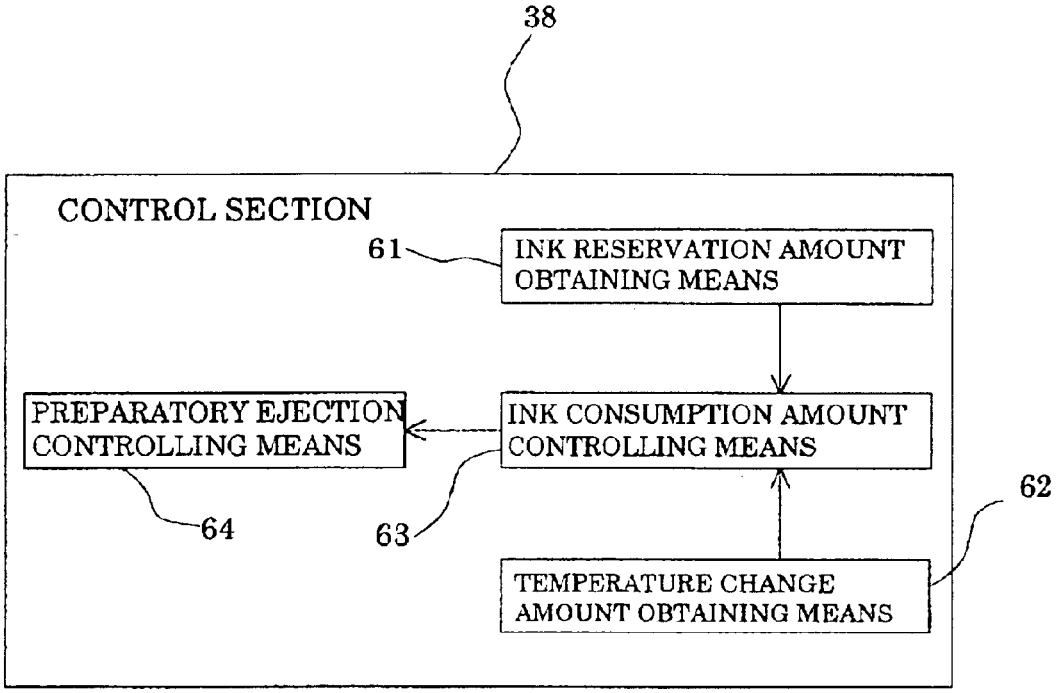
FIG. 12 is a block diagram explaining the constitution of a control section according to the embodiment 2 of the present invention.

FIG. 12 shows the constitution of the control section according to the embodiment 2.

As shown in FIG. 12, this embodiment is similar to the above-described embodiment 1 except preparatory ejection controlling means 64 for allowing the recording head 11 to perform the flushing is provided in the control section 38, and that the ink consumption amount controlling means 63 is allowed to control the ink consumption amount accompanied with the ink ejection during the flushing that the preparatory ejection controlling means 64 allows the recording head 11 to perform.

The preparatory ejection controlling means 64 allows the recording head 11 to execute the flushing independently of the recording operation based on various setting conditions of the flushing controlled by the ink consumption amount controlling means 63.

The ink consumption amount controlling means or section 63 controls the flushing of the recording head 11 to control ink consumption accompanied with ink ejection during flushing. Concretely, in response to the temperature change amount of the recording head obtained by the temperature change amount obtaining means 62 and the ink reservation amount obtained by the ink reservation amount obtaining means 61, the ink consumption amount controlling means 63 selects specified adjustment data from the preparatory ejection operation adjustment data stored in the wrong 37 to control the preparatory ejection controlling means 64 based on the selected adjustment data. Thus, the ink consumption amount controlling moans 63 adjusts the driving signal of the flushing, the number of ejection times and intervals, ejection cycles and the like per one flushing.

Herein, similarly to the above-described embodiment 1, the ink consumption amount controlling means 63 estimates the actual ink temperature in the ink cartridge based on table information as shown in the foregoing Table. 1, and changes various settings such as the pulse form of the driving pulse for the flushing according to the estimated actual ink temperature.

Moreover, in this embodiment, the ink consumption amount controlling means 63 estimates the actual ink temperature by operation, and from the estimated actual ink temperature, various settings such as the pulse form are changed. However, the embodiment is not limited to this. For example, without estimating the actual ink temperature, such various settings as the pulse form may be directly changed from the temperature change amount of the recording head 11 obtained by the temperature change amount obtaining means 62 and the ink reservation amount obtained by the ink reservation amount obtaining means 61 based on the respective adjustment tables for the pulse form and the like, for example, the adjustment tables for the driving voltage, the driving time and the like.

As described above, with the constitution of the embodiment, in response to the ink reservation amount detected by the ink reservation amount obtaining means 61 and the temperature change amount of the recording head 11 obtained by the temperature change amount obtaining means 62, the ink consumption amount controlling means 63 changes the control for the preparatory ejection controlling means 64 with reference to the temperature adjustment table and the like. Accordingly, the ink droplets are favorably ejected at all times with the flushing suitable for the actual ink temperature irrespective of the change of the environmental temperature and the rapid change of the recording head 11 during continuous printing and so on. Thus, printing defects such as the plugging of the nozzle orifice 13 can be prevented accurately.

Moreover, since the ink amount ejected from the recording head 11 during flushing is controlled to be almost constant irrespective of the temperature change amount thereof, the ink consumption amount during the flushing can be precisely grasped by counting the number of flushing times. For this reason, the ink reservation amount obtaining means 61 can precisely obtain the ink reservation amount in the ink reservoir by grasping the ink ejection amount during flushing in the foregoing manner, and further grasping the ink ejection amount during the recording operation and the ink sucking amount during the sucking operation. Furthermore, since the precise ink reservation amount can be obtained, the temperature change amount of the ink can be precisely obtained.

Hereinbelow, the ink ejection operation of the ink-jet recording apparatus according to this embodiment will be described with reference to FIG. 13.

Figure 13:
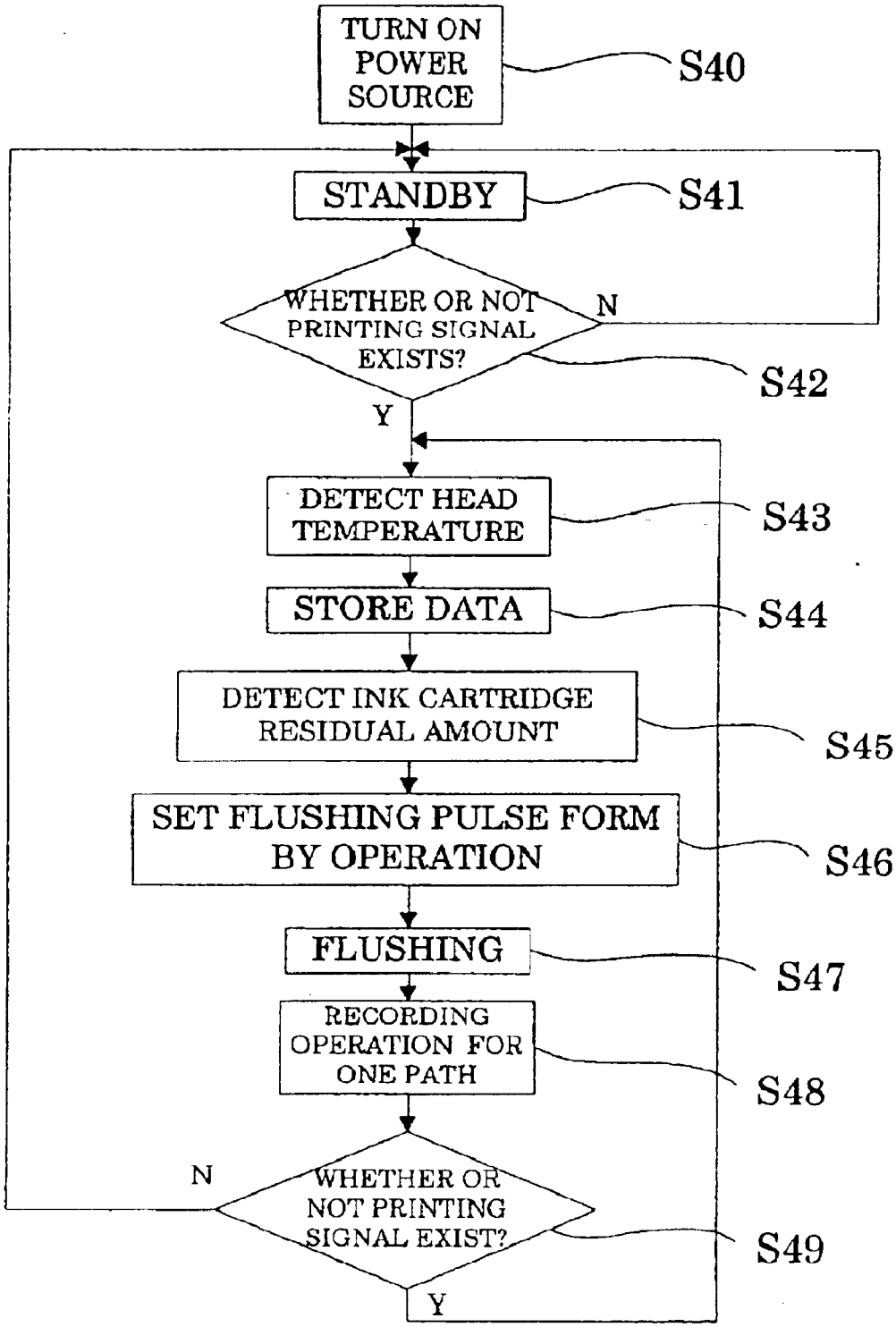
FIG. 13 is a flowchart explaining the operation of an ink-jet printer according to the embodiment 2 of the present invention.

As shown in FIG. 13, when the power source is turned on in step S40, for example, a preparatory operation such as an operation confirmation is performed, then, a standby state waiting for printing is initiated (step S41). Subsequently, when the printing signal is inputted in step S42, the temperature sensor 14 detects the head temperature in step S43, and the detection result is stored in the backup memory 36 by the temperature change amount obtaining means 62 in step S44. Next, in step S45, the ink reservation amount obtaining means 61 obtains the ink reservation amount in the ink cartridge, and in step S46, the ink consumption amount controlling means 63 changes the pulse form based on the adjustment table in response to the ink reservation amount and the temperature change amount of the recording head 11 obtained by the temperature change amount obtaining means 62 with the head temperature information stored in the backup memory 36. Next, in step S47, the preparatory ejection controlling means 64 makes the recording head 11 execute the flushing via the driving signal generating circuit 40. And in step S48, the controlling section 38 makes the recording head 11 move for one path via the driving signal generating circuit 40 to execute the printing. In step S49, in the case where there is a further printing signal, the temperature change amount and the ink reservation amount of the recording head 11 are again obtained, and based on the obtained result, the ink consumption amount controlling means 63 changes the pulse form of the driving pulse, and again performs the flushing and the recording operation for one path (step S43 to S48). The above-described steps S43 to S48 are performed repeatedly, and if the printing signal disappears in step S49, the standby state in step S42 is initiated.

Note that in this embodiment, the flushing is performed after the recording operation for one path. However, the embodiment is not limited to this, and the flushing may be performed after printing one page.

Moreover, in this embodiment, the temperature change amount obtaining means 62 makes the backup memory 36 store the temperature of the recording head 11 detected by the temperature sensor 14. However, the embodiment is not limited to this. For example, the temperature change amount obtaining means 62 may make the backup memory 36 store the temperature change amount of the recording head 11.

Embodiment 3

In the above-described embodiment 2, the temperature change amount of the recording head 11 is detected after the printing signal is inputted. In this embodiment, even when the printing signal is not inputted, that is, in the standby state, the temperature of the recording head 11 is stored in the backup memory 36 by the temperature change amount obtaining means 62.

Hereinbelow, with reference to the flowchart of FIG. 14, the ink ejection operation of the ink-jet recording apparatus according to the embodiment 3 will be described. Note that, in this flowchart, the same step numbers are added to the same processings as those in the above-described embodiment 2, and duplicate descriptions will be omitted.

Figure 14:
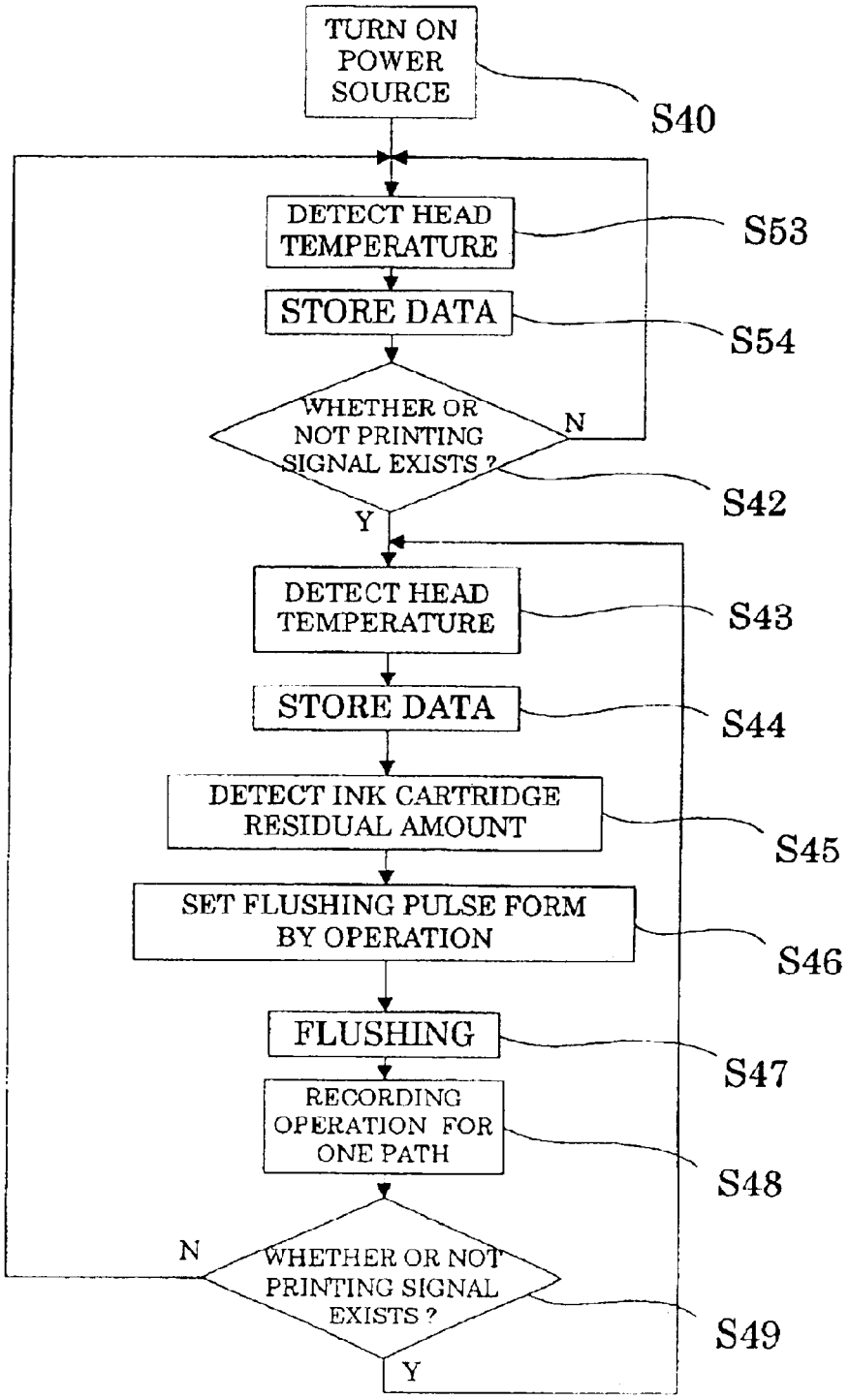
FIG. 14 is a flowchart explaining the operation of an ink-jet printer according to the embodiment 3 of the present invention.

As shown in FIG. 14, when the power source is turned on in step S40, for example, the preparatory operation such as an operation confirmation is performed, then, the temperature sensor 14 detects the temperature of the recording head 11 in step S53, and the detection result is stored in the backup memory 36 by the temperature change obtaining means 62 in step S54. Thereafter, similarly to the above-described embodiment 2, steps S43 to S48 are performed. In step S49, in the case where there is a printing signal, steps S43 to S48 are performed repeatedly. In the case where there is not a printing signal therein (step S43: yes), the processing returns to step S53, and the temperature of the recording head 11 detected by the temperature sensor 14 is continuously stored in the backup memory 36 by the temperature change amount obtaining means 62 until the printing signal is inputted in step S42 (steps S53 and S54).

In this embodiment, in addition to the constitution of embodiment 2, the temperature of the recording head 11 is further stored in the backup memory 36 by the temperature change amount obtaining means 62 even in the standby state. Thus, flushing suitable for the actual ink temperature can be executed based on further information by the ink consumption amount controlling means 63.

Embodiment 4

Figure 15:
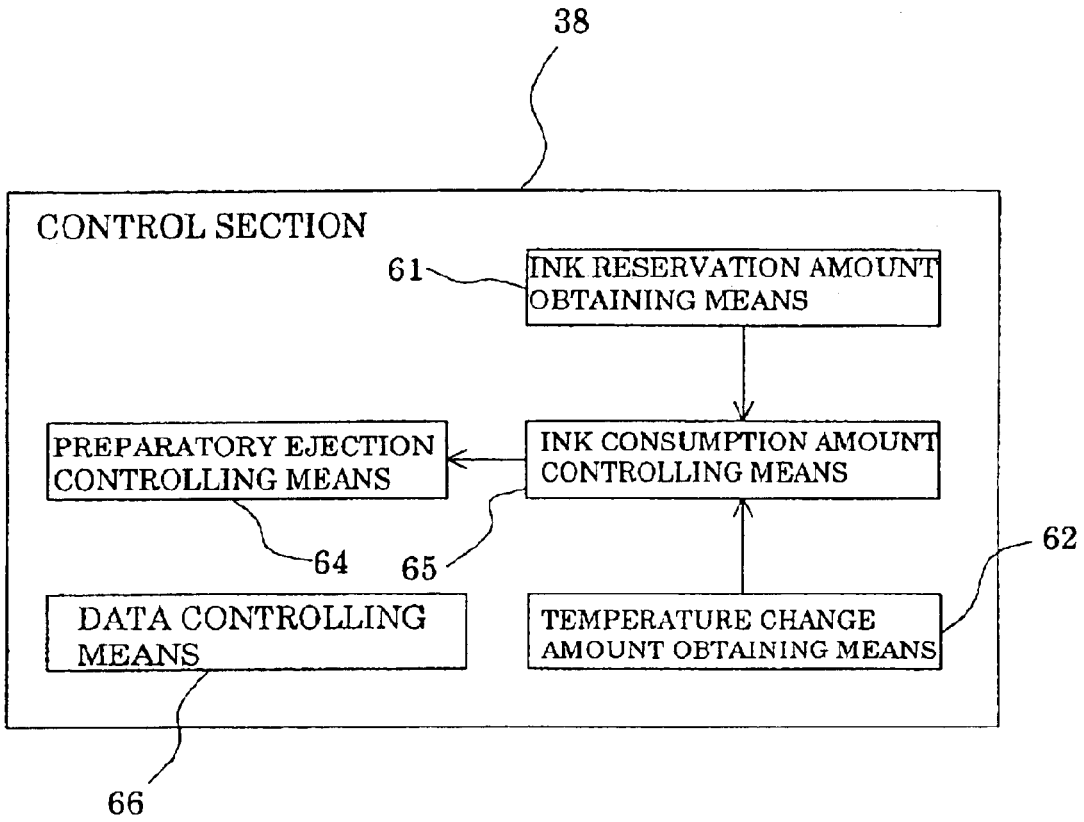
FIG. 15 is a block diagram explaining the constitution of a control section according to the embodiment 4 of the present invention.

FIG. 15 is a block diagram of the ink-jet recording apparatus according to the embodiment 4.

This embodiment is similar to the embodiment 3 except the backup memory 36 storing the head temperature information detected by the temperature sensor 14 is made of a non-volatile memory such as an EEPROM and the data controlling means 66 is provided.

In the case where the time from turning off the power source to turning on the power source is equal to a specified time or greater, this data controlling means 66 discards the head temperature information stored in the backup memory 36, and makes the temperature sensor 14 store the temperature of the recording head 11 in the backup memory 36. In the case where the foregoing time is less than a specified time, the data controlling means 66 controls the backup memory 36 so that the backup memory 36 can hold the head temperature information stored in the backup memory 36 before turning off the power source.

By the data controlling means 66 as described above, the ink consumption amount controlling means 63 adjusts the pulse form of the flushing based on the head temperature information and the ink reservation amount which are stored in the backup memory 36 before the power source is turned off if the time after the power source is turned off is within the specified time. And if the specified time or greater passed since the power source is turned off, the ink consumption amount controlling means 63 adjusts the pulse form of the flushing based on the temperature change amount and the ink reservation amount of the recording head 11 which are obtained by the temperature change amount obtaining means 62 from the head temperature information stored in the backup memory 36 after the power source is turned off.

Hereinbelow, with reference to the flowchart of FIG. 16 the ink ejection operation of the ink-jet recording apparatus according to the embodiment 4 will be described Note that, in this flowchart, the same step numbers are added to the same processings as those in the above-described embodiment 3, and duplicate descriptions will be omitted.

Figure 16:
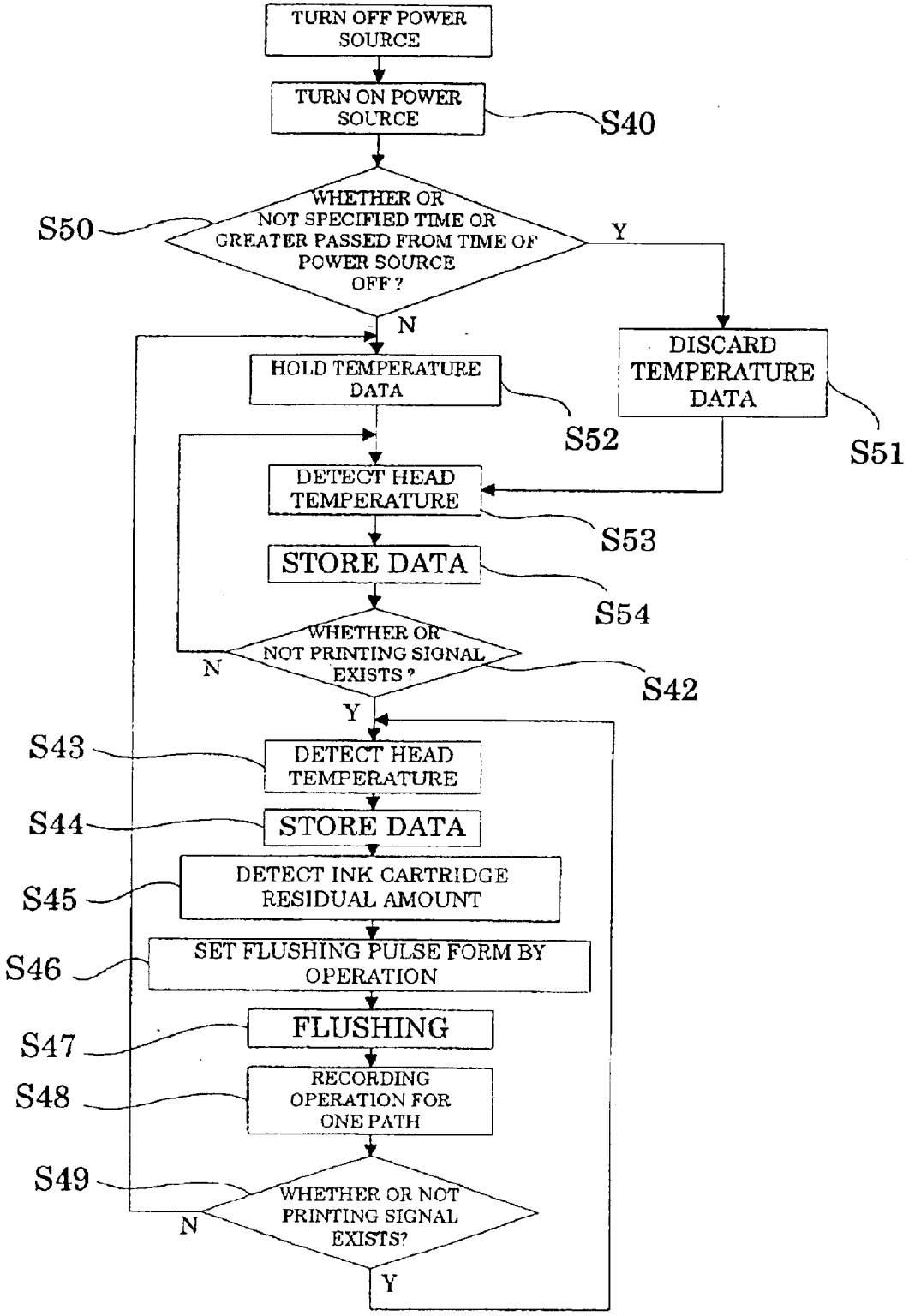
FIG. 16 is a flowchart explaining the operation of an ink-jet printer according to the embodiment 4 of the present invention.

As shown in FIG. 16, when the power source is turned on in step S40, it is determined whether or not a specified time or greater has passed from the time when the power source is turned off and until the power source is turned on in step S50. If the specified time or greater has passed (step S50: Yes), the data controlling means 66 discards the head temperature information stored in the backup memory 36 in step S51. If the specified time or greater has not passed (step S50: No), the data controlling means 66 holds the head temperature information stored in the backup memory 36 in step S52. Thereafter, similarly to the above-described embodiment 3, steps S53 to S49 are performed.

In this embodiment, in addition to the constitution of the embodiment 3, selection can be performed whether the head temperature information stored in the backup memory 36 is held or discarded. Thus, in the case where the power source is turned on for a relatively short time, the flushing suitable for the actual ink temperature can be performed by the ink consumption controlling means 63 by use of the head temperature information previously stored.

Embodiment 5

In the above-described embodiments, 2 to 4, the flushing is performed before the recording operation for one path. However, in this embodiment, the flushing of the above-described embodiment 3 is controlled by the passage of time after the last flushing is executed.

Hereinbelow, with reference to the flowchart of FIG. 17 the ink ejection operation of the ink-jet recording apparatus according to the embodiment 5 will be described. Note that, in this flowchart, the same step numbers are added to the same processings as those in the above-described embodiment 3, and duplicate descriptions will be omitted.

Figure 17:
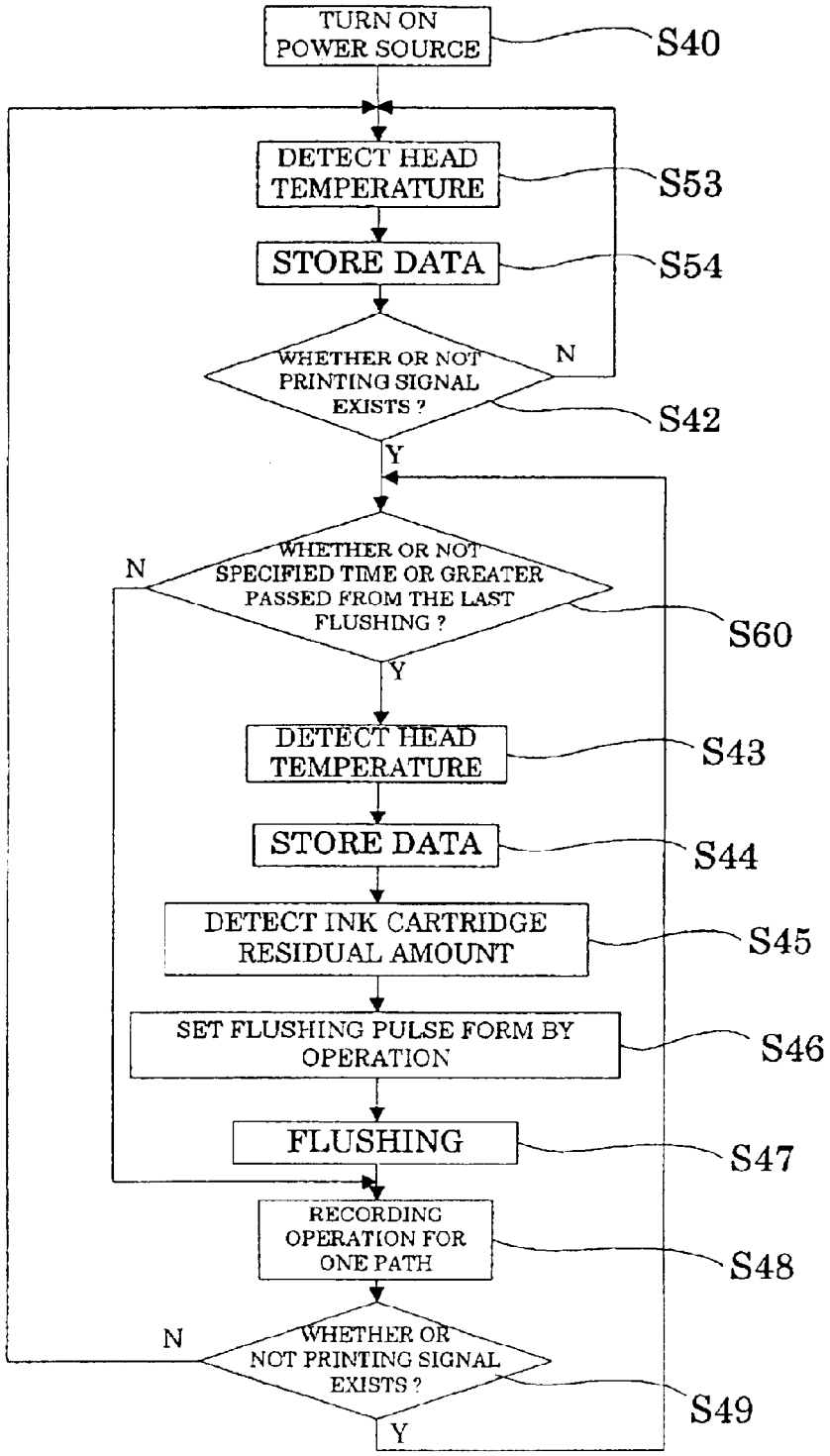
FIG. 17 is a flowchart explaining the operation of an ink-jet printer according to the embodiment 5 of the present invention.

As shown in FIG. 17, when the power source is turned on in step S40, for example, after the preparatory operation such as an operation confirmation is performed, the temperature sensor 14 detects the temperature of the recording head 11 in step S53. And this detection result is stored in the backup memory 36 by the temperature change amount obtaining means 62 is step S54. Thereafter, when the printing signal is inputted in step S42, it is determined whether on not the specified time has passed since the last flushing in step S60. If the specified time or greater has passed (step S60: Yes), steps S43 to S49 are performed similarly to the above-described embodiment 3. If the specified time or greater has not passed (step S60: No), steps S43 to S47, that is, obtaining the temperature change amount of the recording head 11, detecting the ink reservation amount, adjusting the pulse form of the flushing by the ink consumption amount controlling means 63 and flushing are not performed. In step S48, the control section 38 moves the recording head 11 for one path via the driving signal generating circuit 40 to execute the printing. Thereafter, in the case where there is a printing signal in step S49, steps S60 to S48 are performed repeatedly.

As described above, in this embodiment, the interval of the flushing is determined with the passage of time after the last flushing is performed irrespective of the printing amount such as the one-path printing Also with such a constitution, similarly to the above described embodiments 2 to 4, flushing suitable for the actual ink temperature can be performed by the ink consumption amount controlling means 63 in response to the ink reservation amount and the temperature change amount of the recording head 11.

Embodiment 6

In the above-described embodiment 3, the control of the preparatory ejection controlling means 64 is changed for each recording operation for one path by the ink consumption amount controlling means 63. However, in this embodiment, when the flushing is performed one more time within a regulated time, the flushing is performed without changing the control of the preparatory ejection controlling means 64 by the ink consumption amount controlling means 64.

Hereinbelow, with reference to the flowchart of FIG. 18, the ink ejection operation of the ink-jet recording apparatus according to the embodiment 6 will be described. Note that, in this flowchart, the same step numbers are added to the same processings as those in the above-described embodiment 3, and duplicate descriptions will be omitted.

Figure 18:
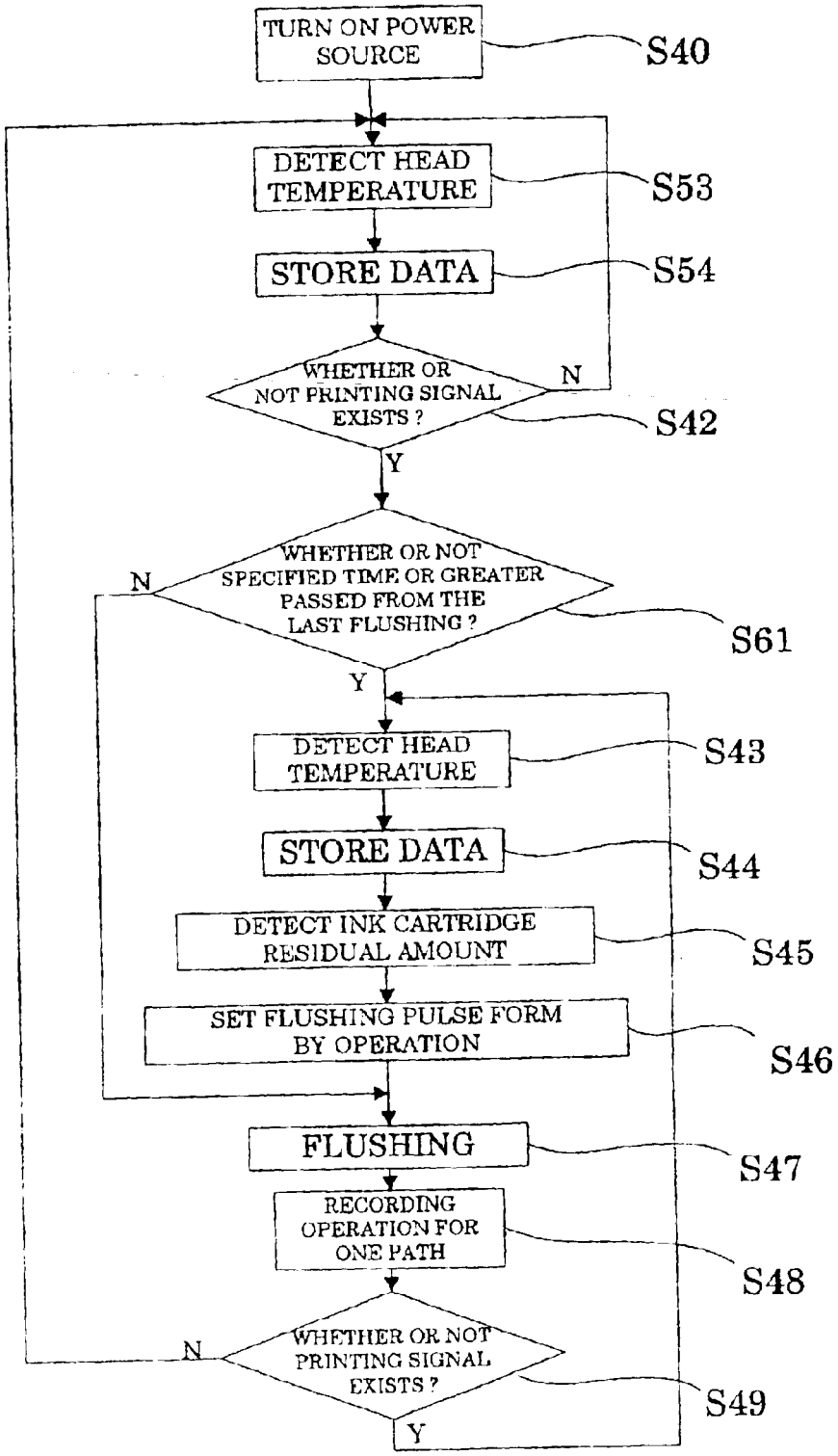
FIG. 18 is a flowchart explaining the operation of an ink-jet printer according to an embodiment 6 of the present invention.

As shown in FIG. 18, when the power source is turned on in step S40, for example, after the preparatory operation such as an operation confirmation is performed, the temperature sensor 14 detects the temperature of the recording head 11 in step S53. This detection result is stored in the backup memory 36 as the temperature change amount of the recording head 11 by the temperature change amount obtaining means 62 in step S54. Thereafter, when the printing signal is inputted in step S42, it is determined whether or not the specified time or greater has passed since the last flushing in step S61. If the specified time or greater has passed (step S61: Yes), steps S43 to S49 are performed similarly to the above-described embodiment 3. If the specified time has not passed (step S61: No), during steps S43 to S46, that is, obtaining of the temperature change amount of the recording head 11, obtaining the ink reservation amount, changing the pulse form of the flushing and so on are not performed, the preparatory ejection controlling means 64 performs the flushing in step S47. Then, in step S48, the control section 38 moves the recording head 11 for one path via the driving signal generating circuit 40 to execute the printing. Thereafter, in the case where there is a printing signal in step S49, steps S43 to S48 are performed repeatedly.

Embodiment 7

In the above described embodiments 1 to 6, the ink consumption amount ejected from the recording head 11 during the recording operation and the preparatory ejection operation or controlled based on the ink reservation amount in the temperature change amount. However, in the embodiment 7, a micro-vibration drive controlling means for making the recording head 11 perform the micro-vibration drive that educates the ink in the pressure chamber 24 and a changing means for adjusting the control of this micro-vibration drive controlling means based on the ink reservation amount and the temperature change amount are further provided. It will be appreciated that the micro-vibration drive controlling means may be refined to also as a micro-vibration drive controlling section and that the changing means may be referred to as a changing section.

Note that, in this embodiment, an example where the micro-vibration drive controlling means and the changing means are provided in the ink-jet recording apparatus, as according to the embodiment 1. However, the micro-vibration drive controlling means and the changing means may be provided in the ink-jet recording apparatus as according to any one of the embodiments 2 to 6.

The micro-vibration drive serves for making the ink in the pressure chamber 24 perform micro-vibration during a specified interval, for example, before the start of printing or an interval between the printing to agitate the ink in the vicinity of the nozzle orifice in the pressure chamber 24, thus preventing the plugging of the nozzle orifice, in order to solve such a problem as generation of the plugging of the nozzle orifice by the increase of the ink viscosity due to the temperature change of the ink accompanied with the change of the environmental temperature of the periphery thereof and the like.

Note that, in the micro-vibration drive, if the ink temperature in the pressure chamber 24 is high and the ink viscosity is low, ink dripping occurs from the nozzle orifice 13. And if the ink temperature is low and the ink viscosity is high, the ink is not agitated sufficiently, thus causing an ejection defect and a printing defect. Since there may occur such problems, a micro-vibration drive suitable for the ink temperature is required to be executed.

Figure 19:
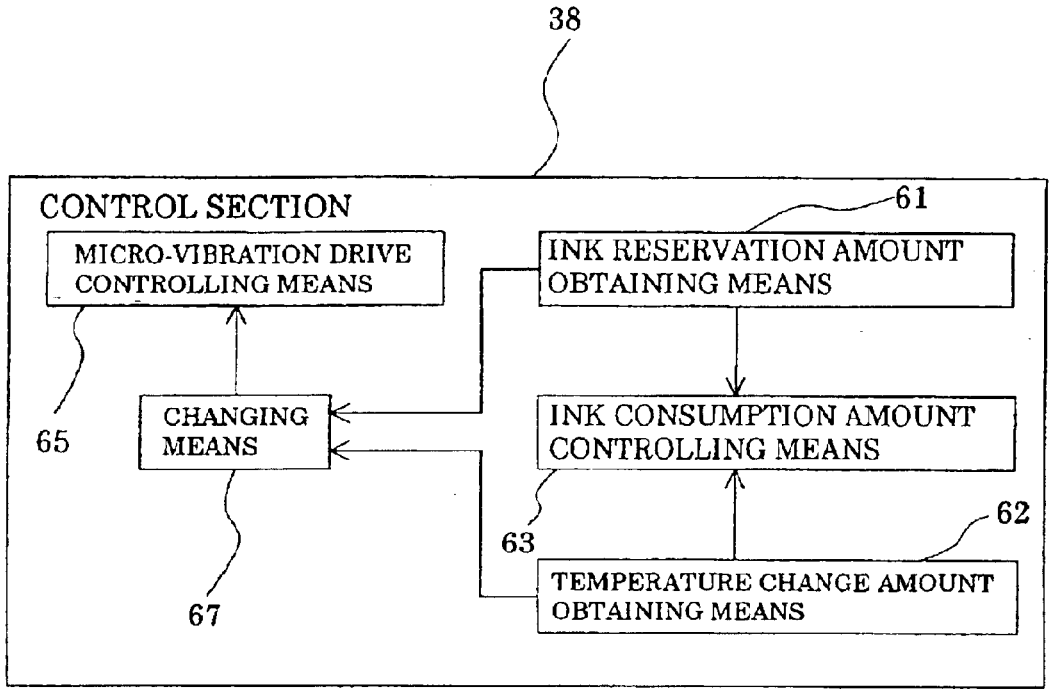
FIG. 19 is a block diagram explaining the constitution of a control section according to the embodiment 7 of the present invention.

FIG. 19 shows a constitution of the controls section according to the embodiment 7.

As shown in FIG. 19, this embodiment is similar to the embodiment 1 except that the micro-vibration drive controlling means 66 for making the recording head 11 execute the micro-vibration drive and changing means 67 for changing the micro-vibration drive controlling means 65 are provided The micro-vibration drive controlling means 65 makes the recording head 11 execute the micro-vibration drive via the driving signal generating circuit 40 based on various setting conditions of the micro-vibration drive which are changed by the changing means 67.

The changing means 67 changes the control for the micro-vibration drive controlling means 65 based on the temperature change amount of the recording head 11 obtained by the temperature change amount obtaining means 62 and the ink reservation amount obtained by the ink reservation amount obtaining means 61 are changed.

Herein, similarly to the ink consumption amount controlling means 63 of the above-described embodiment 1, the changing means 67 estimates the actual ink temperature in the ink cartridge based on such a table as shown in the foregoing Table. 1. And from the estimated ink temperature, various settings such as the pulse form of the driving pulse in the driving signal.

Moreover, in this embodiment, the changing means 67 estimates the actual ink temperature by operation, and the various settings such as the pulse form are changed from the estimated ink temperature. However, the embodiment is not limited to this. For example, without estimating the actual ink temperature, the various settings such as the pulse form may be directly changed based on various adjustment tables for such as the pulse form-for the micro-vibration, for example, the adjustment tables for the driving voltage and the driving time pulse form for the micro-vibration from the temperature change amount of the recording head 11 obtained by the temperature change amount obtaining means and the ink reservation amount obtained by the ink reservation amount obtaining means.

As described above, in the constitution of this embodiment, in response to the ink reservation amount detected by the ink reservation amount obtaining means 61 and the temperature change amount of the recording head 11 obtained by the temperature change amount obtaining means 62, the changing means 67 changes the control for the micro-vibration drive controlling means 65 with reference to the temperature adjustment table and the like. Accordingly, the micro-vibration drive suitable for the actual ink temperature can be performed irrespective of the environmental temperature and the rapid temperature change of the recording head 11 during continuous printing and so on, thus preventing a printing defect due to the plugging of the nozzle orifice 13 and the like.

Moreover, the ink ejection defect and the printing defect due to a shortage of ink agitation and ink drip from the nozzle orifice 13 can be prevented by performing the micro-vibration drive suitable for the actual ink temperature.

Hereinbelow, the micro-vibration drive of this embodiment will be described with reference to the flowchart of FIG. 20.

Figure 20:
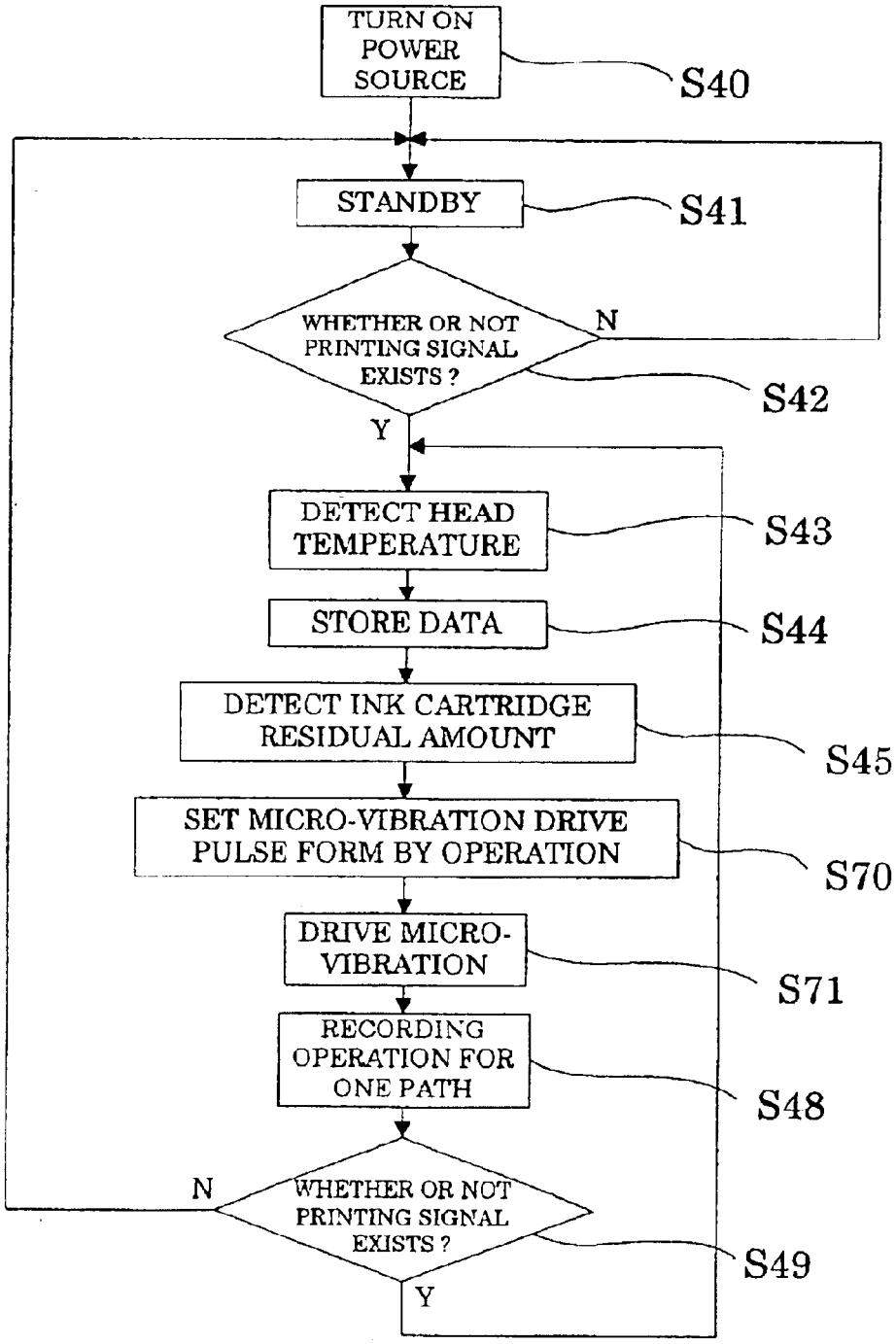
FIG. 20 is a flowchart explaining the operation of an ink-jet printer according to the embodiment 7 of the present invention.

As shown in FIG. 20, when the power source is turned on in step S40, for example, a preparatory operation such as an operation confirmation is performed Then the standby state waiting for the printing is initiated (step S41). Next, when the printing signal is inputted in step S42, the temperature sensor 14 detects the head temperature in step S43, and this detection result is stored in the backup memory 36 by the temperature change obtaining means 62 in step S44. Then, the ink reservation amount obtaining means 61 obtains the ink reservation amount in the ink cartridge 12 in step S45. Then in step S70, in response to the ink reservation amount and the temperature change amount of the recording head 11 obtained by the temperature change amount obtaining means 62 from the head temperature information stored in the backup memory 36, the changing means 67 changes the pulse form based on the adjustment table. Subsequently, in step S71, the micro-vibration drive controlling means 65 makes the recording head 11 execute the micro-vibration drive via the driving signal generating circuit 40. And in step S48, the control section 38 moves the recording head 11 for one path via the driving signal generating circuit 40. Thus, the printing is executed. Since the control of the recording operation at this time is similar to that of the above-described embodiment 1, description thereof will be omitted. In the case where there is a further printing signal in step S49, the temperature change amount of the recording head 11 and the ink reservation amount are again obtained, and the changing means 67 changes the pulse form of the driving pulse based on this obtained result, thus the micro-vibration drive and the recording operation for one path are performed (steps S43 to S48). When steps S43 to S48 are performed repeatedly, and the printing signal disappears in step S49, the standby state in step S42 is initiated.

Note that, in this embodiment, the micro-vibration drive is performed after the recording operation for one path. However, the embodiment is not limited to this. It is a matter of course that the micro-vibration drive may be performed after printing one page.

Moreover, in this embodiment, the temperature change amount obtaining means 62 causes the temperature of the recording head 11 detected by the temperature sensor 14 to be stored in the backup memory 36. However, the embodiment is not limited to this. For example, the temperature change amount obtaining means 62 may make the temperature change amount of the recording head 11 to be stored in the backup memory 36.

Furthermore, in this embodiment, the changing means 67 changes the pulse form for the micro-vibration drive. However, the embodiment is not limited to this. For example, in addition to the pulse form, various setting conditions for the micro-vibration drive such as the number of micro-vibration driving times, the interval of the micro-vibration drive and the cycle of the micro-vibration drive may be changed, or any one of the foregoing conditions may be changed. The change of the various setting conditions is preferably performed in such a manner that the number of the micro-vibration driving times is increased, the interval of the micro-vibration drive is shortened, and the cycle of the micro-vibration drive is shortened because the ink viscosity is high when the ink temperature is low in comparison with the ink viscosity at a high temperature. The various settings may be set by performing operation from the adjusted ink temperature, or each setting may be set based on each adjustment table.

Other Embodiments

The ink-jet recording head of the present invention has been described hereinabove. However, the ink-jet recording head is not limited to this. For example, in the above-described embodiments 2 to 6, the ink consumption amount obtaining means 63 changes the pulse form for flushing. However, the ink-jet recording head is not limited to this. For example, in addition to the pulse form, the ink consumption amount obtaining means 63 may change various setting conditions for flushing such as the number of flushing times, the interval of flushing and the cycle of flushing or may change any one of the foregoing setting conditions. The change of the various setting conditions is preferably performed in such a manner that the number of flushing times is increased, the interval of flushing is shortened, and the cycle of the flushing is shortened because the ink viscosity is high when the ink temperature is low in comparison with the ink viscosity at a high temperature. The various settings may be set by performing operation from the adjusted ink temperature, or each setting may be set based on each adjustment table.

Moreover, in the above-described embodiments 2 to 6, flushing is performed before the printing, however a similar effect is obtained also by performing flushing after printing.

Furthermore, flushing provides similar effects for preventing a color mixture after cleaning the recording head and for regular printing and printing in bulk when performing printing for a long time.

As described above, in the embodiments 2 to 6, the control of the preparatory ejection is changed independently of the driving signal during regular printing. Thus, the preparatory ejection that is always appropriated can be executed irrespective of the change of the environmental temperature.

It is needles to say that the control of the driving signal for regular printing may be performed together with the control of the driving signal for the preparatory ejection.

Furthermore, the ink-jet recording method described in the above-described embodiments 1 to 6 may be provided in a form stored in various recording media such as a floppy disk and a CD-ROM, as a program for adjusting the driving signal of the ink-jet recording apparatus, or a program for changing the control of the preparatory ejection operation. Still further, the ink-jet recording method may be executed by updating a control program stored in a memory for rewriting the storage device of the host computer or the printer, or by installing the method in a RAM and the like.

Although the preferred embodiments of the present invention have been described in detail, it should be understood that various changes, substitutions and alternations can be made therein without departing from the spirit and scope of the inventions as defined by the appended claims.

Advantage of the Invention

As described above, according to the present invention, the ink consumption amount controlling means controls the ink consumption amount in the recording head based on the temperature change amount obtained by the temperature change amount obtaining means and the ink reservation amount obtained by the ink reservation amount obtaining means. With such a constitution, when the environmental temperature is rapidly changed in a short time, even if the temperature of the ink reserved in the ink reservoir is changed after the change of the environmental temperature, the ink consumption amount controlling means can grasp the ink temperature at the point of time when it is changed based on the temperature change amount. Accordingly, ink consumption can be maintained to be always constant, thus ink ejection can be performed appropriately. Moreover, the preparatory ejection can be performed appropriately at all times and the ink consumption amount can be grasped precisely by controlling ink consumption accompanied with ink ejection during the preparatory ejection operation in response to the ink temperature. Furthermore, the sucking operation can be performed appropriately by controlling the ink consumption amount during the sucking operation.

As described above, even when the environmental temperature is changed to a large extent for a short time due to the operation of an air conditioner and so on, the consumption amount of the ink droplets can be made to be constant irrespective of the change of the environmental temperature. As a result, the image quality can be stabilized Moreover, the plugging of the nozzle orifice of the recording head, printing defects and the like can be prevented by performing the preparatory ejection operation in response to the ink temperature in the ink cartridge. Furthermore, since the ink consumption amount can be grasped precisely, the precise ink reservation amount can be obtained Although the preferred embodiments of the present invention have been described in detail, it should be understood that various changes, substitutions and alternations can be made therein without departing from the spirit and scope of the invention as defined by the appended claims.

What is claimed is:

1. An ink-jet recording apparatus, which has a recording head provided close to an ink reservoir, said recording head ejecting ink from the ink reservoir, and driving signal generating means that generates a driving signal for ejecting ink droplets, comprising:

ink reservation amount obtaining means for obtaining the ink reservation amount in said ink reservoir;

temperature change amount obtaining means for obtaining the temperature change amount per unit of time of said recording head by a temperature sensor mounted on the recording head; and ink consumption amount controlling means for controlling the ink consumption amount of said recording head based on the temperature change amount per unit of time of the recording head obtained by said temperature change amount obtaining means and the ink reservation amount obtained by said ink reservation amount obtaining means.

2. The ink-jet recording apparatus according to claim 1, wherein said ink reservation amount obtaining means detects the ink consumption amount and obtains the ink reservation amount in said ink reservoir.

3. The ink-jet recording apparatus according to claim 1, wherein said temperature change amount obtaining means comprises temperature detecting means for detecting the temperature of the recording head and temperature information storing means for storing the head temperature information from the temperature detecting means.

4. The ink-jet recording apparatus according to claim 3, wherein said temperature information storing means stones the recording head temperature information from the time when a power source is turned on.

5. The ink-jet recording apparatus according to claim 3, wherein said temperature information storing means stores the head temperature information in the waiting state of the recording operation.

6. The ink-jet recording apparatus according to claim 3, wherein said temperature information storing means holds the stored head temperature information even after the power source is turned off.

7. The ink-jet recording apparatus according to claim 6, wherein said temperature change amount obtaining means obtains the temperature change amount by using the head temperature information held in the temperature information storing means when the power source is turned on again within a specified time after power source is turned off.

8. The ink-jet recording apparatus according to claim 1, wherein said driving signal generating means generates a driving signal that makes the recording head perform a recording operation, and said ink consumption amount controlling means adjusts the driving signal for the recording operation.

9. The ink-jet recording apparatus according to claim 8, wherein said driving signal generating means generates a driving signal including the driving pulse for ejecting ink droplets, and said ink consumption amount controlling means adjusts the driving voltage of the driving pulse based on the temperature change amount and the ink reaction amount.

10. The ink-jet recording apparatus according to claim 8, wherein said driving signal generating means generates the driving signal including the driving pulse for ejecting ink droplets, and said ink consumption amount controlling means adjusts the pulse form of the driving pulse based on the temperature change amount and the ink reservation amount.

11. The ink-jet recording apparatus according to claim 1, wherein the ink consumption amount controlling means controls the ink consumption amount on the basis of the ink reservation amount and the temperature change amount per unit of time of the recording head, while taking actual ink temperature into consideration.

12. The ink-jet recording apparatus according to claim 11, wherein the ink consumption amount controlling means controls the ink consumption amount by inferring an actual ink temperature on the basis of the ink reservation amount and the temperature change amount per unit of time of the recording head, and in accordance with the thus inferred ink temperature.

13. The ink-jet recording apparatus according to claim 11, wherein the ink consumption amount controlling means in order to directly control a parameter to be used in controlling the ink: consumption amount, without inferring actual ink temperature, on the basis of the ink reservation amount and the temperature change amount per unit of time of the recording head.

14. An ink-jet recording method, the method including use of a recording head provided close to an ink reservoir, said recording head ejecting ink from the ink reservoir, and driving signal generating means for generating a driving signal to eject droplets, the method comprising the steps of:

obtaining the ink reservation amount in said ink reservoir and obtaining the temperature change amount per unit of time of said recording head by a temperature sensor mounted on the recording head; and controlling the ink consumption amount of said recording head based on the temperature change amount per unit of time of said recording head and said ink reservation amount.

15. The ink-jet recording method according to claim 14, wherein said step of obtaining a temperature change amount of a recording head comprises the steps of:

detecting the temperature of said recording head; and storing the detect head temperature information.

16. The ink-jet recording method according to claim 15, wherein during said step of storing head temperature information, the head temperature information is stored from the time the power source is turned on.

17. The ink-jet recording method according to claim 15, wherein during said step of storing the head temperature information, the head temperature information in the waiting state of the recording operation is stored.

18. The ink-jet recording method according to claim 15, wherein during said step of storing head temperature information the stored head temperature information is held even after the power source is turned off.

19. The ink-jet recording method according to claim 18, wherein during said step of obtaining the temperature change amount of the recording head, the temperature change amount is obtained by using the stored detected head temperature, when the power source is turned on again within a specified time after the power source is turned off.

20. The ink-jet recording method according to claim 14, wherein during said step of controlling the ink consumption amount, the driving signal that makes a said recording head perform to recording operation is adjusted.

21. The ink-jet recording method according to claim 20, wherein said adjustment of the driving signal of the recording operation is an adjustment of the driving voltage for the pulse form, which is included in the driving signal for ejecting ink droplets.

22. The ink-jet recording method according to claim 20, wherein said adjustment of the driving signal of the recording operation is an adjustment of the pulse form of the driving pulse, which is included in the driving signal for ejecting ink droplets.

23. The ink-jet recording method according to claim 14, wherein said step of controlling the ink consumption amount further includes the ink consumption amount being controlled on the basis of the ink reservation amount and the temperature change amount per unit of time of the recording head, while taking actual ink temperature into consideration.

24. The ink-jet recording method according to claim 23, wherein said step of controlling the ink consumption amount further includes the ink consumption being controlled by inferring an actual ink temperature on the basis of the ink reservation amount and the temperature change amount per unit of time of the recording head, and in accordance with the thus inferred ink temperature.

25. The ink-jet recording method according to claim 23, wherein said step of controlling the ink consumption amount further includes directly controlling a parameter to be used in controlling the ink consumption amount, without inferring actual ink temperature, on the basis of the ink reservation amount and the temperature change amount per unit of time of the recording head.

26. A computer program product for controlling the ink consumption amount of an ink-jet recording apparatus, comprising:

a recording medium capable of being read by a computer, and a program of computer readable instructions adapted to enable the control of an ink-jet recording apparatus to perform the steps of:

executing printing by using a recording head provided close to an ink reservoir, said recording head ejecting ink from the ink reservoir;

obtaining an ink reservation amount in said ink reservoir;

obtaining a temperature change amount of said recording head; and controlling the ink consumption amount of the recording head based on said temperature change amount per unit of time of said recording head-by a temperature sensor mounted on the recording head and said ink reservation amount.

27. The computer program product for controlling the ink consumption amount of an ink jet recording apparatus according to claim 26, wherein controlling the ink consumption amount of the recording head includes controlling the ink consumption amount on the basis of the ink reservation amount and the temperature change amount per unit of time of the recording head, while taking actual ink temperature into consideration.

28. The computer program product for controlling the ink consumption amount of an ink jet recording apparatus according to claim 27, wherein said controlling the ink consumption amount includes controlling the ink consumption amount by interfering an actual ink temperature on the basis of the ink reservation amount and the temperature change amount per unit of time of the recording head, and in accordance with the thus inferred ink temperature.

29. The computer program product for controlling the ink consumption amount of an ink jet recording apparatus according to claim 27, wherein said controlling the ink consumption amount includes directly controlling a parameter to be used in controlling the ink consumption amount, without inferring actual ink temperature, on the basis of the ink reservation amount and the temperature change amount per unit of time of the recording head.

30. An ink-jet recording apparatus, comprising:

a recording head, an ink reservoir, a drive signal generating section, an ink reservation amount obtaining section, a temperature change amount obtaining section, and an ink consumption amount controlling section;

said recording head provided close to said ink reservoir, said recording head receiving ink from the ink reservoir;

said drive signal generating section generating a driving signal;

said recording head ejecting ink droplets of said ink based on said driving signal, at an ink consumption amount;

said ink reservation amount obtaining section obtaining an ink reservation amount in said ink reservoir;

said temperature change amount obtaining section obtaining a temperature change amount per unit of time of said recording head by a temperature sensor mounted on the recording head; and said ink consumption amount controlling section controlling said ink consumption amount of said recording head based on said temperature change amount per unit of time and ink reservation amount.

31. The ink-jet recording apparatus according to claim 30, wherein said ink reservation amount obtaining section detects the ink consumption amount and obtains the ink reservation amount in said ink reservoir.

32. The ink-jet recording apparatus according to claim 30, wherein said temperature change amount obtaining section comprises a temperature detecting section for detecting the temperature of the recording head and a temperature information storing section for storing the head temperature information from the temperature detecting section.

33. The ink-jet recording apparatus according to claim 32, wherein said temperature information storing section stores the recording head temperature information from the time when a power source is turned on.

34. The ink-jet recording apparatus according to claim 32, wherein said temperature information storing section stores the head temperature information in the waiting state of the recording operation.

35. The ink-jet recording apparatus according to claim 32, wherein said temperature information storing section holds the stored head temperature information even after the power source is turned off.

36. The ink-jet recording apparatus according to claim 35, wherein said temperature change amount obtaining section obtains the temperature change amount by using the head temperature information held in the temperature information storing section when the power source is turned on again within a specified time after power source is turned off.

37. The ink-jet recording apparatus according to claim 30, wherein said driving signal generating section generates a driving signal that makes the recording head perform a recording operation, and said ink consumption amount controlling section adjusts the driving signal for the recording operation.

38. The ink-jet recording apparatus according to claim 37, wherein said driving signal generating section generates a driving signal including the driving pulse for ejecting ink droplets, and said ink consumption amount controlling section adjusts the driving voltage of the driving pulse based on the temperature change amount and the ink reservation amount.

39. The ink-jet recording apparatus according to claim 37, wherein said driving signal generating section generates the driving signal including the driving pulse for ejecting ink droplets, and said ink consumption amount controlling section adjusts the pulse form of the driving pulse based on the temperature change amount and the ink reservation amount.

40. The ink-jet recording apparatus according to claim 30, wherein said ink consumption amount controlling section controls the ink consumption amount on the basis of the ink reservation amount and the temperature change amount per unit of time of the recording head, while taking actual ink temperature into consideration.

41. The ink-jet recording apparatus according to claim 40, wherein said ink consumption amount controlling section controls the ink consumption amount by inferring an actual ink temperature on the basis of the ink reservation amount and the temperature change amount per unit of time of the recording head, and in accordance with the thus inferred ink temperature.

42. The ink-jet recording apparatus according to claim 40, wherein said ink consumption amount controlling section directly controls a parameter to be used in controlling the ink consumption amount, without inferring actual ink temperature, on the basis of the ink reservation amount and the temperature change amount per unit of time of the recording head.

43. An ink-jet recording method, in which the ink-jet recording apparatus has a recording head provided close to an ink reservoir, said recording head ejecting ink from the ink reservoir, and a driving signal generating section for generating a driving signal to eject droplets, the method comprising the steps of:

obtaining the ink reservation amount in said ink reservoir and obtaining the temperature change amount per unit of time of said recording head by a temperature sensor mounted on the recording head; and controlling the ink consumption amount of said recoding head based on the temperature change amount per unit of time of said recording head and said ink reservation amount.

44. The ink-jet recording method according to claim 43, wherein said ink reservation amount is obtained by calculation based on totalization of the ink consumption amount.

45. The ink-jet recording method according to claim 43, wherein said step of obtaining a temperature change amount of a recording head comprises the steps of:

detecting the temperature of said recording head; and storing the detected head temperature information.

46. The ink-jet recording method according to claim 45, wherein during said step of storing head temperature information, the head temperature information is stored from the time when the power source is turned on.

47. The ink-jet recording method according to claim 45, wherein during said step of storing the head temperature information, the head temperature information in the waiting state of the recording operation is stored.

48. The ink-jet recording method according to claim 45, wherein during said step of storing head temperature information, the stored head temperature information is held even after the power source is turned off.

49. The ink-jet recording method according to claim 48, wherein during said step of obtaining the temperature change amount of the recording head, the temperature change amount is obtained by using the stored detected head temperature information, when the power source is turned on again within a specified time after the power source is turned off.

50. The ink-jet recording method according to claim 43, wherein during said step of controlling the ink consumption amount, the driving signal that makes the recording head perform the recording operation is adjusted.

51. The ink-jet recording method according to claim 50, wherein said adjustment of the driving signal of the recording operation is an adjustment of the driving voltage for the pulse form, which is included in the driving signal for ejecting ink droplets.

52. The ink-jet recording method according to claim 50, wherein said adjustment of the driving signal of the recording operation is an adjustment of the pulse form of the driving pulse, which is included in the driving signal for ejecting ink droplets. controlling the ink consumption amount includes directly controlling a parameter to be used in controlling the ink consumption amount, without inferring actual ink temperature, on the basis of the ink reservation amount and the temperature change amount per unit of time of the recording head.

53. The ink-jet recording method according to claim 43, wherein said step of controlling the ink consumption amount further includes the ink consumption amount being controlled on the basis of the ink reservation amount and the temperature change amount per unit of time of the recording head, while taking actual ink temperature into consideration.

54. The ink-jet recording method according to claim 53, wherein said step of controlling the ink consumption amount further includes the ink consumption amount being controlled by inferring an actual ink temperature on the basis of the ink reservation amount and the temperature change amount per unit of time of the recording head, and in accordance with the thus inferred ink temperature.

55. The ink-jet recording method according to claim 53, wherein said step of controlling the ink consumption amount further includes directly controlling a parameter to be used in controlling the ink consumption amount, without inferring actual ink temperature, on the basis of the ink reservation amount and the temperature change amount per unit of time of the recording head.

56. An ink-jet recording apparatus, which has a recording head provided close to an ink reservoir, said recording head ejecting ink from the ink reservoir, and driving signal generating means that generates a driving signal for ejecting ink droplets, comprising:

ink reservation amount obtaining means for obtaining the ink reservation amount in said ink reservoir;

temperature change amount obtaining means for obtaining the temperature change amount per unit of time of said recording head by a temperature sensor mounted on the recording head; and ink consumption amount controlling means for controlling the ink consumption amount of said recording head based at least on the ink reservation amount as a function of the temperature change amount per unit of time.

57. The ink-jet recording apparatus of claim 56, wherein the ink reservation amount as a function of the temperature change amount per unit of time is based on the formula:

$$T=Tt+k\Delta T,$$

wherein T= the ink temperature Tt= the detected head temperature, k is an adjustment coefficient, and ΔT is a temperature change amount.

58. An ink-jet recording method, the method including use of a recording head provided close to an ink reservoir, said recording head ejecting ink from the ink reservoir, and driving signal generating means for generating a driving signal to eject droplets, the method comprising the steps of:

obtaining the ink reservation amount in said ink reservoir and obtaining the temperature change amount per unit of time of said recording head by a temperature sensor mounted on the recording head; and controlling the ink consumption amount of said recording head based at least on the ink reservation amount as a function of a temperature change amount per unit of time.

59. The ink-jet recording method of claim 58, wherein the ink reservation amount as a function of the temperature change amount per unit of time is based on the formula:

$$T=Tt+k\Delta T,$$

wherein T=the ink temperature. Tt=the detected head temperature, k is an adjustment coefficient, and ΔT is a temperature change amount.

60. A computer program product for controlling the ink consumption amount of an ink-jet recording apparatus, comprising:

a recording medium capable of being read by a computer, and a program of computer readable instructions adapted to enable the control of an ink-jet recording apparatus to perform the steps of:

executing printing by using a recording head provided close to an ink reservoir, said recording head ejecting ink from the ink reservoir;

obtaining an ink reservation amount in said ink reservoir;

obtaining a temperature change amount of said recording head; and controlling the ink consumption amount of the recording head based at least on the ink reservation amount as a function of the temperature change amount per unit of time.

61. The computer program product of claim 60, wherein the ink reservation amount as a function of the temperature change amount per unit of time is based on the formula:

$$T=Tt+k\Delta T,$$

wherein T=the ink temperature, Tt=the detected head temperature, k is an adjustment coefficient, and ΔT is a temperature change amount.

62. An ink-jet recording apparatus, comprising:

a recording head, an ink reservoir, a drive signal generating section, an ink reservation amount obtaining section, a temperature change amount obtaining section, and an ink consumption amount controlling section;

said recording head provided close to said ink reservoir, said recording head receiving ink from the ink reservoir, said drive signal generating section generating a driving signal;

said recording head ejecting ink droplets of said ink, based on said driving signal, at an ink consumption amount;

said ink reservation amount obtaining section obtaining an ink reservation amount in said ink reservoir, said temperature change amount obtaining section obtaining a temperature change amount per unit of time of said recording head by a temperature sensor mounted on the recording head; and said ink consumption amount controlling section controlling said ink consumption amount of said recording head based on at least the ink reservation amount as a function of the temperature change amount per unit of time.

63. The ink-jet recording apparatus of claim 62, wherein the ink reservation amount as a function of the temperature change amount per unit of time is based on the formula:

$$T=Tt+k\Delta T,$$

wherein T=the ink temperature, Tt=the detected head temperature, k is an adjustment coefficient, and ΔT is a temperature change amount.

64. An ink-jet recording method, in which the ink-jet recording apparatus has a recording head provided close to an ink reservoir, said recording head ejecting ink from the ink reservoir, and a driving signal generating section for generating a driving signal to eject droplets, the method comprising the steps of:

obtaining the ink reservation amount in said ink reservoir and obtaining the temperature change amount per unit of time of said recording head by a temperature sensor mounted on the recording head; and controlling the ink consumption amount of said recording head based on at least the ink reservation amount as a function of the temperature change amount per unit of time,.

65. The ink-jet recording method of claim 64, wherein the ink reservation amount as a function of the temperature change amount per unit of time is based on the formula:

$$T=Tt+k\Delta T,$$

wherein T=the ink temperature, T=the detected head temperature, k is an adjustment coefficient, and ΔT is a temperature change amount.

66. A printer system for printing ink to a page, including:

an ink reservoir;

a detector that detects a level of ink in the ink reservoir and produces an ink level output signal based on said level of ink;

a recording head;

a temperature sensor that detects the temperature of the recording head and produces a recording head-temperature signal;

a controller that receives said ink-level output signal and said recording head-temperature signal, said controller controlling the consumption of ink consumed by said recording head based on an amount of change per unit of time in the temperature of said recoding head and said level of ink contained in said ink reservoir.

67. The printer system of claim 66, including at least one memory device that stores said recording head-temperature signal from the time when a power source is turned on.

68. The printer system of claim 67, wherein said at least one memory device stores the recording head-temperature signal in a waiting state of a recording operation.

69. The printer system of claim 68, wherein said at least one memory device holds said stored recording head-temperature signal even after a power source is turned off.

70. The printer system of claim 69, wherein said controller obtains a temperature change amount by using said at least one memory device when said power source is turned on again within a specified time after said power source is turned off.

71. The printer system of claim 66, wherein said controller generates a driving signal that makes said recording head perform a recording operation.

72. The printer system of claim 71, wherein said driving signal includes a driving pulse for ejecting ink droplets from said recording head, and said controller adjusts a driving voltage of the driving pulse based on information denoting a temperature change amount and an ink level amount received via said ink-level output signal and said recording head-temperature signal.

* * * * *